US007777118B2

(12) United States Patent
Stoneback

(10) Patent No.: US 7,777,118 B2
(45) Date of Patent: Aug. 17, 2010

(54) ELECTROMAGNETIC MUSICAL INSTRUMENT SYSTEMS AND RELATED METHODS

(76) Inventor: Russell Stoneback, 7760 McCallum Blvd., No. 16107, Dallas, TX (US) 75252

( * ) Notice: Subject to any disclaimer, the term of this patent is extended or adjusted under 35 U.S.C. 154(b) by 302 days.

(21) Appl. No.: 11/325,296

(22) Filed: Jan. 4, 2006

(65) Prior Publication Data

US 2007/0017344 A1 Jan. 25, 2007

Related U.S. Application Data

(60) Provisional application No. 60/702,184, filed on Jul. 25, 2005.

(51) Int. Cl.

| | |
|---|---|
| ***G10H 1/00*** | (2006.01) |
| ***G10H 1/02*** | (2006.01) |
| ***G10H 1/06*** | (2006.01) |
| ***G10H 1/12*** | (2006.01) |
| ***G10H 3/18*** | (2006.01) |
| ***G10D 3/00*** | (2006.01) |

(52) U.S. Cl. ..... 84/600; 84/291; 84/622; 84/626; 84/661; 84/726

(58) Field of Classification Search ..... 84/600, 84/622, 626, 291, 726, 661
See application file for complete search history.

(56) References Cited

U.S. PATENT DOCUMENTS

| | | | | | |
|---|---|---|---|---|---|
| 2,106,771 | A | * | 2/1938 | Southworth | 331/97 |
| 2,307,011 | A | * | 1/1943 | Barrow | 342/350 |
| 3,234,485 | A | * | 2/1966 | Graser, Jr. | 331/107 T |
| 3,274,406 | A | * | 9/1966 | Sommers, Jr. | 310/334 |
| 3,769,871 | A | * | 11/1973 | Cawthorn | 84/291 |
| 4,031,798 | A | * | 6/1977 | Sidner | 84/291 |
| 4,185,534 | A | * | 1/1980 | Cove | 84/291 |
| 4,213,370 | A | * | 7/1980 | Jones | 84/291 |
| 4,245,540 | A | * | 1/1981 | Groupp | 84/726 |
| 4,290,336 | A | * | 9/1981 | Peavey | 84/291 |
| 4,308,784 | A | * | 1/1982 | Eizonas | 84/452 R |
| 4,313,362 | A | * | 2/1982 | Lieber | 84/267 |
| 4,334,452 | A | * | 6/1982 | Morrison et al. | 84/723 |
| 4,545,278 | A | * | 10/1985 | Gagon et al. | 84/726 |
| 4,672,671 | A | * | 6/1987 | Kennedy | 381/61 |

(Continued)

OTHER PUBLICATIONS

M. R. Schroeder, "Normal Frequency and Excitation Statistics in Rooms: Model Experiments with Electric Waves." J. Audio Eng. Soc., vol. 35, No. 5, May 1987, p. 307-316.

(Continued)

*Primary Examiner*—Jeffrey Donels
*Assistant Examiner*—Christina Russell
(74) *Attorney, Agent, or Firm*—Klemchuk Kubasta LLP; Darin M. Klemchuk

(57) ABSTRACT

An electromagnetic (EM) musical instrument system includes an excitation signal generator to generate an excitation signal. The system also includes an excitation signal applier coupled to the excitation signal generator. The excitation signal applier receives the excitation signal and transmits a corresponding excitation signal to an EM musical instrument. The excitation signal applier is further configured to modulate the corresponding excitation signal to produce audio effects. An EM musical instrument, in response to receiving the corresponding excitation signal, generates an EM output signal associated with a produced sound. The system also includes an EM output receiver coupled to the EM musical instrument to receive the EM output signal.

41 Claims, 5 Drawing Sheets

U.S. PATENT DOCUMENTS

| | | | | | |
|---|---|---|---|---|---|
| 4,738,178 | A * | 4/1988 | Deering | 84/726 |
| 4,829,870 | A * | 5/1989 | Ralston | 84/291 |
| 4,873,907 | A * | 10/1989 | Decker et al. | 84/291 |
| 4,913,024 | A * | 4/1990 | Carriveau | 84/726 |
| 4,977,808 | A * | 12/1990 | Thacker | 84/291 |
| 5,054,356 | A * | 10/1991 | Farnell, Jr. | 84/291 |
| 5,072,643 | A * | 12/1991 | Murata | 84/293 |
| 5,142,961 | A * | 9/1992 | Paroutaud | 84/726 |
| 5,333,527 | A * | 8/1994 | Janes et al. | 84/291 |
| 5,406,874 | A * | 4/1995 | Witchel | 84/291 |
| 5,442,986 | A * | 8/1995 | Cota | 84/267 |
| 5,585,581 | A * | 12/1996 | Rogers | 84/414 |
| 5,585,588 | A * | 12/1996 | Tumura | 84/726 |
| 5,777,255 | A * | 7/1998 | Smith et al. | 84/661 |
| 5,866,834 | A * | 2/1999 | Burke et al. | 84/622 |
| 5,889,221 | A * | 3/1999 | Dejima | 84/291 |
| 5,895,872 | A * | 4/1999 | Chase | 84/291 |
| 5,900,561 | A * | 5/1999 | Wechter | 84/267 |
| 5,905,219 | A * | 5/1999 | Westheimer | 84/452 P |
| 5,905,222 | A * | 5/1999 | Yamada | 84/630 |
| 5,994,633 | A * | 11/1999 | Norton | 84/290 |
| 6,107,552 | A * | 8/2000 | Coomar et al. | 84/291 |
| 6,114,616 | A * | 9/2000 | Naylor | 84/291 |
| 6,255,567 | B1 * | 7/2001 | Minakuchi | 84/291 |
| 6,284,957 | B1 * | 9/2001 | Leguia | 84/275 |
| 6,284,965 | B1 * | 9/2001 | Smith et al. | 84/661 |
| 6,298,140 | B1 * | 10/2001 | Manavopoulos | 381/152 |
| 6,298,141 | B1 * | 10/2001 | Hickman | 381/333 |
| 6,359,208 | B1 * | 3/2002 | Farnell, Jr. | 84/726 |
| 6,420,638 | B2 * | 7/2002 | Teel | 84/293 |
| 6,538,183 | B2 * | 3/2003 | Verd | 84/291 |
| 6,542,857 | B1 * | 4/2003 | Holzrichter et al. | 703/2 |
| 6,605,766 | B2 * | 8/2003 | Teel | 84/291 |
| 6,653,538 | B1 * | 11/2003 | Wells | 84/291 |
| 6,686,522 | B2 * | 2/2004 | Won et al. | 84/291 |
| 6,787,690 | B1 * | 9/2004 | Celi et al. | 84/723 |
| 6,800,797 | B2 * | 10/2004 | Steiger, III | 84/267 |
| 6,849,795 | B2 * | 2/2005 | Ludwig | 84/661 |
| 6,960,715 | B2 * | 11/2005 | Riopelle | 84/725 |
| 6,969,794 | B2 * | 11/2005 | Suzuki | 84/600 |
| 6,969,795 | B2 * | 11/2005 | Hofmeister et al. | 84/600 |
| 7,279,631 | B2 * | 10/2007 | Celi et al. | 84/735 |
| 2002/0101391 | A1 * | 8/2002 | Kanamaluru et al. | 343/915 |
| 2002/0114481 | A1 * | 8/2002 | Watanabe | 381/334 |
| 2002/0198690 | A1 * | 12/2002 | Holzrichter et al. | 702/195 |
| 2003/0149553 | A1 * | 8/2003 | Holzrichter | 703/2 |
| 2004/0099329 | A1 * | 5/2004 | Klaui et al. | 139/448 |
| 2004/0245085 | A1 * | 12/2004 | Srinivasan | 204/157.15 |
| 2005/0051022 | A1 * | 3/2005 | Hodder et al. | 84/724 |
| 2005/0076767 | A1 * | 4/2005 | McCabe | 84/313 |
| 2005/0109197 | A1 * | 5/2005 | Garrett et al. | 84/726 |
| 2005/0265508 | A1 * | 12/2005 | Kessler | 376/156 |
| 2006/0174753 | A1 * | 8/2006 | Aisenbrey | 84/600 |
| 2008/0023014 | A1 * | 1/2008 | Gallick | 128/897 |

OTHER PUBLICATIONS

H.J. Stockmann and J. Stein, "Quantum" Chaos in Billiards Studied by Microwave Aborption. The American Physical Society, Physical Review Letters, vol. 64, No. 19. May 7, 1990, p. 2215-8.

S. Sridhar and A. Kudrolli, Experiments on Not "Hearing the Shape" of Drums. The American Physical Society, Physical Review Letters, vol. 72, No. 14. Apr. 4, 1994, p. 2175-8.

Herotek, Inc., a California corporation, "Heroteck, Inc. RF and Microwave Components," Web: http//:www.herotek.com/. Accessed: Jan. 3, 2006.

Ian M. Firth, "Physics of the guitar at the Helmholtz and first top plate resonances", J. Acoustic. Soc. Am., vol. 61, No. 2, Feb. 1977.

J. Watkins, "Circular Resonant Structures in Microstrip", Electronics Letters, vol. 5, No. 21, Oct. 1969, p. 524-525.

Shinichiro Ohnuki, Takashi Hinata and Toshio Hosono, "Resonant Characteristics of Parallel Plate Waveguide Cavities with Irises", IEEE Conf., May 17-21, 1999, pp. 272-276, 199.

Shuhua Jiang, D. R. Jackson, S. A. Long, "Characteristics of the shorted annular-ring patch antenna", IEEE CNF, Jun. 20-24, 1994, pp. 464-467, vol. 1, Ap-S. Digest, Antennas and Propagation Society Intt'l Symposium.

S. A. Long, "Impedance of a circular-disc printed-circuit antenna", Electronics Letters, vol. 14, No. 21, Oct. 1978, pp. 684-686.

Ruey-Shi Chu and Shii-Shyong Wang, "An analysis on current excitation of a circular resonant microstrip disc", IEEE CNF, vol. 17, Jun. 1979, pp. 105-106, Antennas and Propagat.

L.C. Chen, S.A Long, et al, "Resonant Frequency of a circular disc, printed-circuit antenna," IEEE Trans. Ant. Prop., vol. 25, Issue 4, Jul. 1977, 595-596.

Zhi Ning Chen and M.Y.W. Chia, "Broadband probe-fed notched plate antenna," Electronics Letters, Mar. 2000, vol. 36, No. 7, pp. 599-600.

* cited by examiner

ELECTROMAGNETIC MUSICAL INSTRUMENT SYSTEMS AND RELATED METHODS

CROSS REFERENCE TO RELATED APPLICATIONS

This application claims priority and the benefit under 35 U.S.C. §119(e) from U.S. Provisional Patent Application Ser. No. 60/702,184 entitled "Electromagnetic musical instruments and related method" and filed on Jul. 25, 2005.

U.S. Provisional Patent Application Ser. No. 60/701,184 is commonly assigned to the assignee of the present application. The disclosure of U.S. Provisional Patent Application Ser. No. 60/702,184 is hereby incorporated by reference for all purposes as if fully set forth herein.

TECHNICAL FIELD

The present disclosure relates generally to musical instruments and in particular to electromagnetic musical instrument systems and methods.

BACKGROUND

Generally, Acoustic musical instruments produce sounds that are audible to the human ear and travel from the instrument or other sound source through propagation of pressure and velocity waves, typically through the atmosphere. These waves include material particles made up of atoms. For example, mono-atomic Hydrogen gas atoms, a component of the atmosphere, have a positively charged central nucleus and an orbiting negatively charged electron cloud. This spatial separation of charge in each atom creates an electric field, even though the atom or particle itself may be electrically neutral. Charge neutrality, however, ensures that the electric field operates only over a very short distance.

Generally, a musical field is a field that can be exploited to create music. Musicality is a subjective property and, as such, can only be determined by listening to the behavior in question. However, since Acoustic fields are known to be musical, other fields capable of solutions found in Acoustic systems are also musical.

For example, Acoustic exhibit highly similar resonance behavior inside closed cavities, as described in more detail below.

Conventional musical instrument development has attempted to create new behaviors and new sounds, from both a purely Acoustic and electro-Acoustic perspective. For example, modern drums have developed significantly since the early invention of the first drum. Similarly, the invention of the electric guitar provided an entirely new palette of sonic options. The versatility of the electric guitar stems, in part, from its ability to encode the fundamentally Acoustic vibration of a string into an electrical signal. The resultant electrical signal can then be routed through any number of electrical devices that purposely affect the waveform of the electrical signal to create new sounds.

For example, as described above, a common musical effect is "distortion." Distortion can be achieved by applying an electrical signal to a transistor, and driving the transistor through voltage swings greater than the operational range of the transistor. Other well-known effects can be produced through a combination of transistors, capacitors, vacuum tube amplifiers, inductors, and other suitable electrical and/or electronic devices.

Likewise, the development of conventional computer systems allowed for even further development of new sounds. For example, the modem personal computer allows for manipulation of digital signals. Input signals can be converted from analog to digital signals, manipulated, and then either played directly or converted back to analog signals for listening. In some instances, the input signals are generated by the computer system itself, based on mathematical models of known Acoustic systems. In fact, entire compositions have been produced wholly through conventional computer-simulated Acoustic-based instruments.

Recent developments in modern musical instruments have applied techniques to manipulate Acoustic signals. While transistors, capacitors, and other like devices are Electromagnetic systems, the underlying musical behavior is founded on the original Acoustic field behavior. In other words, a substantially Acoustic signal is converted to an electric representation of that signal and then manipulated by electronic devices. Similarly, computer-generated music is essentially a simulation and/or manipulation of fundamentally Acoustic field behavior. The musical behavior of Electromagnetic fields generally, or even the particular Electromagnetic fields associated with typical modern musical instruments, however, remains untapped.

There is therefore a need for Electromagnetic musical instrument systems and methods.

SUMMARY

The problems presented in traditional musical instruments are solved by the systems and methods of the present invention. In accordance with one embodiment of the present invention, an electromagnetic (EM) musical instrument is provided. The EM musical instrument comprises a body comprising a shape and having EM characteristics that differ from one or more EM characteristics of a free space adjacent to the EM musical instrument. A port is coupled to the body and configured to receive an excitation signal and to apply the received excitation signal to the body. Accordingly, an EM musical instrument allows novel musical sounds to be created.

An electromagnetic (EM) musical instrument system is also provided. The EM musical instrument system comprises an excitation signal generator configured to generate an excitation signal. An excitation signal applier is coupled to the excitation signal generator and configured to receive the excitation signal and to transmit the excitation signal to an EM musical instrument. The EM musical instrument is configured to receive the excitation signal and to generate an EM output signal in response to the received excitation signal. An EM output receiver is configured to receive the EM output signal. Accordingly, novel musical sounds can be created and manipulated.

In an alternate embodiment, the EM musical instrument system further comprises an EM output effects module coupled to the EM output receiver and configured to modify the received EM output signal for audio effects. In an alternate embodiment, the EM output effects module further comprises an analog to digital converter. In an alternate embodiment, the EM musical instrument system further comprises an EM output converter coupled to the EM output receiver and configured to convert the received EM output signal to an audio output signal at an audible frequency. Accordingly, further novel musical sounds can be created.

In an alternate embodiment, the EM musical instrument system further comprises an interface coupled to the excitation signal generator and to the Internet and configured to receive remote user input and to operate the excitation signal generator in response to received remote user input. A user interface is coupled to the Internet and configured to receive local user input, to generate remote user input in response to received local user input, and to transmit remote user input to the interface. Accordingly, novel musical sounds can be created and manipulated remotely. Further, musicians who would not otherwise be able to travel to an EM musical instrument system can operate the system remotely to create novel musical sounds.

In an alternate embodiment, the EM musical instrument system further comprises an interface coupled to the EM output receiver and to the Internet and configured to generate a remote output signal in response to the EM output signal. A user interface is coupled to the Internet and configured to receive the remote output signal and to generate an audio output signal, in response to the received remote output signal. Accordingly, novel musical sounds can be created and manipulated remotely.

A method for generating electromagnetic music is also provided. An excitation signal is generated. The excitation signal is applied to an electromagnetic (EM) musical instrument. The EM musical instrument comprises a body comprising a shape and having EM characteristics that differ from one or more EM characteristics of a free space adjacent to the EM musical instrument, and a port coupled to the body and configured to receive the excitation signal and to apply the received excitation signal to the body. The response of the EM musical instrument to the excitation signal is measured. The measured response is recorded to generate an electromagnetic musical signal. Accordingly, novel musical sounds can be generated.

In an alternate embodiment, the method further comprises manipulating the electromagnetic musical signal for audio effects. In an alternate embodiment, the method further comprises frequency converting the electromagnetic musical signal to an audible signal. In an alternate embodiment, the method further comprises receiving user input and wherein the excitation signal is generated in response to received user input. In still another embodiment, the method further comprises polarizing the excitation signal to generate a polarized signal and applying the polarized signal to the EM musical instrument. Accordingly, further novel musical sounds can be created.

In an alternate embodiment, the method further comprises receiving user input from a user through a connection to the Internet. The excitation signal is generated in response to received user input. The electromagnetic musical signal is converted for transmission over the Internet. And the converted electromagnetic musical signal is transmitted to the user through a connection to the Internet. Accordingly, novel musical sounds can be created through remote access to an EM musical instrument.

Other objects, features, and advantages of the present invention will become apparent with reference to the drawings and detailed description that follow.

BRIEF DESCRIPTION OF THE DRAWINGS

For a more complete understanding of this disclosure and its features, reference is now made to the following description, taken in conjunction with the accompanying drawings, in which.

DETAILED DESCRIPTION

Figure 1:
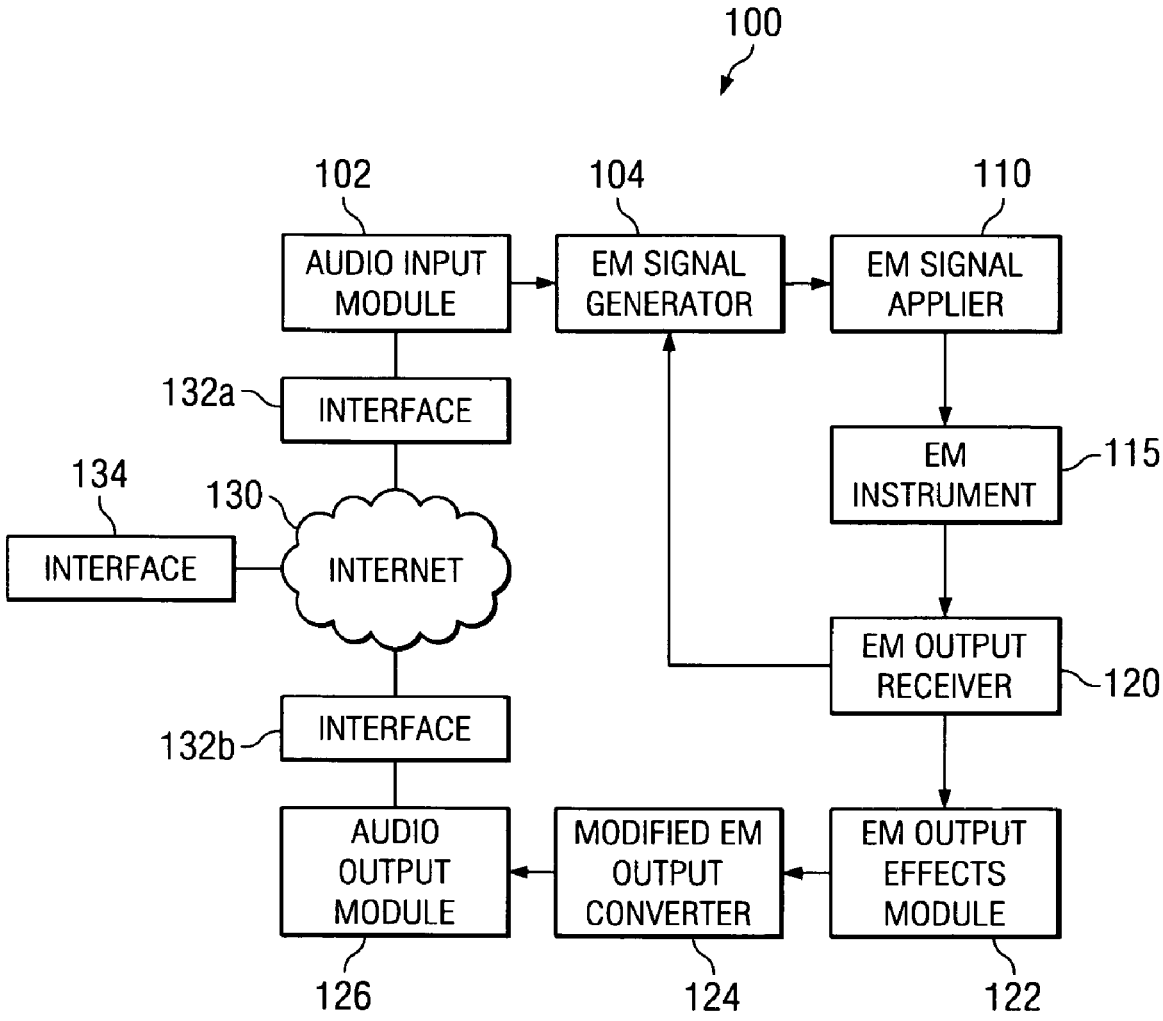
FIG. 1 is a somewhat simplified block diagram illustrating an electromagnetic instrument system according to one embodiment of the present disclosure.

The present disclosure generally provides systems and methods related to an electromagnetic (EM) musical instrument. In one embodiment, the present disclosure provides a high frequency electrical device that generally employs the resonance of electromagnetic fields inside a body of an instrument to produce music.

When two individual gas particles travel towards each other, the limited distance over which each as particle's electric field operates also limits the interaction of one particle's electric field with the other particle's electric field, until the particles are relatively close to each other. One skilled in the art would understand that charges in an Electromagnetic field experience a force that can be described by the relationship shown in Equation 1 below.

$$\vec{F}=q(\vec{E}+\vec{v}\times\vec{B}) \quad \text{(Eqn. 1)}$$

In Equation 1, $\vec{F}$ is force, $\vec{E}$ is the Electric field, $\vec{B}$ is the Magnetic Induction field, q is charge, and $\vec{v}$ is velocity. For velocities small compared to light that is, where $$|\vec{v}|\ll c_e \approx 3\times 10^8\frac{m}{s},$$

the $\vec{v}\times\vec{B}$ component is not significant, and the relationship can be reduced to the relationship shown in Equation 2 below.

$$\vec{F}=q\vec{E} \quad \text{(Eqn. 2)}$$

Thus, when the gas particles are close enough to each other, the magnitude of the electric field rises rapidly and the two gas particles are repelled from each other. This "collision" is analogous to two billiard balls colliding, although the gas particles do not come into physical contact. These gas particle collisions are the mechanism by which pressure and velocity waves exist and propagate through a medium, such as, for example, the atmosphere, giving rise to sounds audible to the human ear.

These collisions are essentially unaffected by the Magnetic Induction field $\vec{B}$, which also masks the full complexity of the Electromagnetic behavior of the collisions. However, while the $\vec{v} \times \vec{B}$ component is not significant, it is also non-zero. Thus, suggesting that even substantially Acoustic fields exhibit certain fundamentally Electromagnetic behavior. As substantially Acoustic fields are musical fields and exhibit Electromagnetic behavior, substantially Electromagnetic fields could be considered musical fields.

According to one embodiment of the present disclosure, there are several special cases where Electromagnetic fields exhibit similar behavior as Acoustic fields. For example, Acoustic and Electromagnetic fields both exhibit highly similar resonance behavior inside closed cavities, as described in more detail below. For two-dimensional cavities, the spatial dependence of both Acoustic and Electromagnetic fields is essentially the same. For source-less three-dimensional cavities, the Acoustic and Electromagnetic solutions diverge, in part because of the Electromagnetic field's more complex nature. However, the more complex Electromagnetic field solution nevertheless encompasses the Acoustic solution. Moreover, the additional behavior of the Electromagnetic field can be described by the same Acoustic solution for a partially open cavity. Thus, an Electromagnetic field in a source-less closed cavity includes two different Acoustic responses, which complement each other and produce a novel tone. As such, at least some Electromagnetic fields are musical fields according to one aspect of the present disclosure.

According to one embodiment of the present disclosure, electromagnetic fields are capable of supporting musical instruments. Furthermore, while certain Electromagnetic fields could be described by solutions that approximate Acoustic field solutions, substantially Electromagnetic fields exhibit significantly different behavior from typical substantially Acoustic fields. However, according to one embodiment of the present disclosure and with respect to musical instruments, new behaviors bring new instrument sounds. Since at least some Electromagnetic fields are musical, new Electromagnetic fields can exhibit musical and, therefore desired, behavior.

Electromagnetic Musical Instrument Systems

FIG. 1 is a somewhat simplified block diagram illustrating an exemplary EM Instrument system 100 according to one embodiment of the present disclosure. For ease of illustration, some of the components of EM Instrument system 100 and their interaction are introduced generally and described in further detail below. Generally, EM Instrument system 100 includes an audio input module 102. Audio input module 102 is configured to receive audio, acoustic, or other musical input or information and to generate an electrical signal based on received input, as described in more detail below. Audio input module 102 is coupled to Electromagnetic (EM) signal generator 104.

EM signal generator 104 is configured to receive input from audio input module 102 as an electrical signal, and to generate an Electromagnetic signal based on the received input. The generated Electromagnetic signal is passed to EM signal applier 110, which applies the generated Electromagnetic signal to an EM Instrument 115. EM Instrument 115 is an electromagnetic instrument configured to respond to an applied Electromagnetic signal, as described in more detail below. For ease of illustration, the Electromagnetic signal applied to EM Instrument 115 is sometimes referred to herein as an "excitation signal." EM output receiver 120 is coupled to EM Instrument 115 and is configured to measure and/or otherwise record the response of EM Instrument 115 to the applied Electromagnetic signal.

EM output receiver 120 generates an electrical signal, the EM output signal, based on the measured and/or recorded response of EM Instrument 115 to the excitation signal, and passes the generated EM output signal to EM output effects module 122. In one embodiment, EM output receiver 120 could be coupled to EM signal generator 104 and could be further configured to receive the EM output signal from EM output receiver 120 and to modify the excitation signal in response to the received EM output signal.

EM output effects module 122 receives the EM output signal and modifies the signal in accordance with one or more desired musical effects and other desirable waveform manipulations, generating a modified EM output signal. Examples of desired musical effects include, for example, distortion, wah, delay, echo, and chorus. The modified EM output signal is passed to modified EM output converter 124.

Modified EM output converter 124 receives the modified EM output signal and converts the modified EM output signal into an audio output signal, which is passed to audio output module 126. In one embodiment, modified EM output converter 124 converts the frequency of the modified EM signal to an audio output signal in the human-audible frequency range.

Audio output module 126 receives the audio output signal for additional processing, musical effects, playback, recording, or real-time listening. In one embodiment, audio output module 126 converts the audio output signal to a human-audible pressure or velocity wave, such as that produced by a loudspeaker. In the illustrated embodiment, particular functions have been ascribed to specific modules. In an alternate embodiment, one or more specific functions performed by one or more components can be combined into a single component or set of components. For example, in one embodiment, EM output receiver 120, EM output effects module 122, modified EM output converter, and audio output module 126 can be combined into a single module. One skilled in the art will understand that other configurations can could also be employed in accordance with the present disclosure.

In one embodiment, EM Instrument system 100 could be coupled to a network, such as, for example, Internet 130 through one or more interfaces 132*a* and/or 132*b* (sometimes collectively referred to herein as interfaces 132) as shown in FIG. 1. So configured, a remote user can operate EM Instrument system 100 by providing commands and/or other input through a user interface 134 coupled to Internet 130. For example, a user can provide musical information and/or other input to audio input module 102 through interface 132*a*, and receive an audio output signal in response to provided input through interface 132*b*. In the illustrated embodiment, user interface 134 and interfaces 132 are otherwise conventional network and/or Internet interfaces. In an alternate embodiment, interfaces 132*a* and 132*b* can be configured as computer workstations and can be operated in physical proximity to the rest of system 100. In an alternate embodiment, interfaces 132*a* and 132*b* can comprise a single interface. One skilled in the art will understand that other configurations can also be employed according to the present disclosure.

Accordingly, user interface 134 and interfaces 132 can be configured in a variety of ways to couple to Internet 130, audio input module 102, and/or audio output module 126. As described in more detail below, EM isolation and possible size issues of EM Instruments make distance operation advantageous—the musicians can travel to the instrument rather than carry the instrument with them. Accordingly, EM instrument system 100 is also configured for remote and/or distance operation over the Internet. One skilled in the art will understand that details concerning network connections, protocols, systems, and the like are unnecessary for a complete understanding of the present disclosure.

Thus, generally, EM Instrument system 100 is configured to receive and/or generate audio input, convert the audio input to an EM excitation signal, apply the excitation signal to an EM Instrument, record the EM Instrument's response to the applied excitation signal and generate a corresponding EM output signal, and convert the EM output signal to an audio output signal, with or without modification. One skilled in the art will understand that therefore, generally, EM Instrument system 100 can be conceptually subdivided into two parts: the EM Instrument itself, and the systems that support and enhance operation of the EM Instrument.

Electromagnetic Musical Instrument Methods

Figure 2:
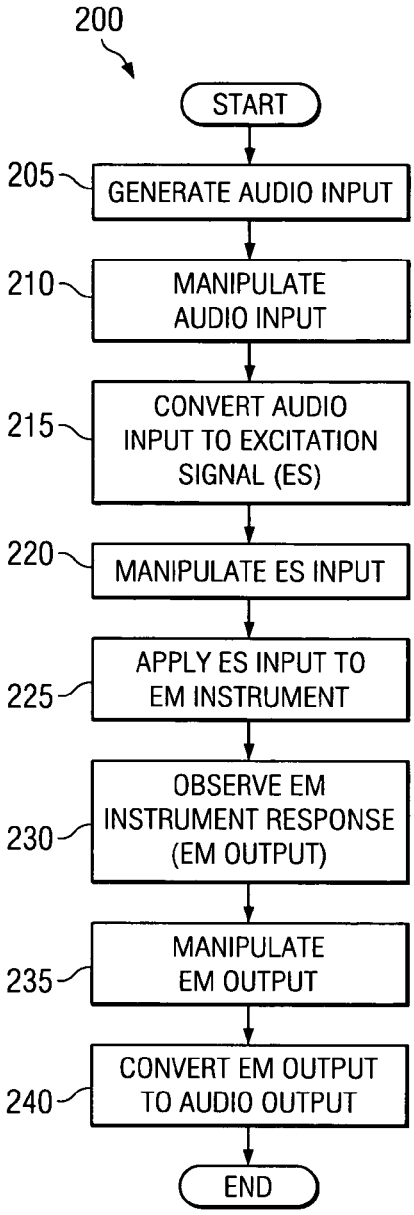
FIG. 2 is a somewhat simplified flow diagram illustrating an exemplary method of providing music using an electromagnetic instrument according to one embodiment of the present disclosure.

For ease of illustration and understanding, reference is now made to FIG. 2, which illustrates one method in which the components of EM Instrument system 100 interact and operate. Reference numeral 200 generally designates a flow diagram comprising the steps of the method.

The process generally begins at step 205 where audio input is generated. This step can be performed by, for example, audio input module 102 of FIG. 1. As described in additional detail below, "audio input" can include analog, real-time musical input from a standard musical instrument, or can be digitized representations of sounds, or other input.

At step 210, the audio input is manipulated for audio effects. This step can be performed by, for example, audio input module 102 of FIG. 1. One skilled in the art will understand that this step is optional and could be omitted.

At step 215, the audio input is converted to an EM excitation signal. This step can be performed by, for example, EM signal generator 104 of FIG. 1. As described in additional detail below, in one embodiment, this step can include a frequency conversion from the audible band to the EM band. Moreover, in an alternate embodiment, EM signal generator 104 is configured to generate an EM excitation signal in response to other input, such as, for example, user input from an interface (not shown). In such embodiments, the excitation signal is not based on any physical audio input, but is generated as an original signal.

At step 220, the EM excitation signal is manipulated for various effects. This step can be performed by, for example, EM signal generator 104 of FIG. 1. For example, in one embodiment, EM signal generator 104 can modulate the excitation signal in response to the EM output signal received from EM output receiver 120, or in response to user input. This step can also be performed by, for example, EM signal applier 110 of FIG. 1. For example, in one embodiment, EM signal applier 110 could includes a polarization filter that restricts the excitation signal to a particular desired polarity.

At step 225, the excitation signal is applied to an EM Instrument. This step can be performed by, for example, EM signal applier 110 of FIG. 1. As described in additional detail below, the excitation signal can be configured in a variety of ways and can therefore be "applied" to the EM Instrument in a variety of ways. For example, in one embodiment, the excitation signal is conveyed to the EM Instrument through a wire and applied through a wire loop physically connected to the EM Instrument. In an alternate embodiment, the excitation signal is "broadcast" at the instrument, with no permanent physical connection between the EM signal applier and the EM Instrument. One skilled in the art will understand that other configurations can also be employed, some of which are described in additional detail below.

At step 230, the response of the EM Instrument to the excitation signal is observed. This step can be performed by, for example, EM output receiver 120 of FIG. 1. As described in additional detail below, "observing" the EM Instrument's response can include measuring and recording the EM output signal generated by the EM Instrument in response to the excitation signal.

At step 235, the observed EM output signal is manipulated. This step can be performed by, for example, EM output receiver 120 of FIG. 1. For example, in one embodiment, EM output receiver 120 includes a polarization filter that restricts the EM output signal to a particular desired polarity. This step can also be performed by, for example, EM output effects module 122 of FIG. 1. For example, in one embodiment, EM output receiver 120 can comprise an antenna and EM output effects module 122 can include a polarization filter that restricts the EM output signal to a particular desired polarity. In an alternate embodiment, EM output effects module 122 can be configured to manipulate the EM output signal in response to user input from an interface (not shown).

At step 240, the EM output signal is converted to an audio output signal. This step can be performed by, for example, modified EM output converter module 124 of FIG. 1. As described in additional detail below, in one embodiment, this step can include a frequency conversion from the EM band to the audible band. Moreover, in an alternate embodiment, this step can include manipulating the audio output signal for audio effects. This step can be performed by, for example, audio output module 126 of FIG. 1.

Thus, the components and broad operation of one embodiment of the present disclosure are generally illustrated in FIGS. 1 and 2.

Electromagnetic Musical Instrument Theoretical Underpinnings

Before describing additional details of how the various components are configured to operate, independently and together, some theoretical underpinnings are helpful. Following the theoretical and mathematical support, several embodiments of the EM Instrument and system 100 of the present disclosure are generally described in additional detail.

As described above, theoretical understanding of EM Musical Instruments begins with understanding of Acoustic systems. Generally, the pressure and velocity of a linearised, isentropic, small-signal Acoustic field can be described by the following equations, Equations 3 and 4 below.

$$\nabla^2 P - \frac{1}{c_a^2}\frac{\partial^2 P}{\partial t^2} = -\rho_0 \frac{\partial q}{\partial t} + \vec{\nabla}\cdot\vec{F_b} \quad \text{(Eqn. 3)}$$

$$\nabla(\nabla\cdot\vec{V}) - \frac{1}{c_a^2}\frac{\partial^2 \vec{V}}{\partial t^2} = \nabla q - \frac{1}{c_a^2}\frac{\partial^2 \vec{F_b}}{\partial t} \quad \text{(Eqn. 4)}$$

In Equations 3 and 4, P is pressure, $\vec{V}$ is velocity, $c_a$ is the propagation speed of Acoustic fields, $\rho_0$ is the static mass density of the gas, $\vec{F_b}$ is force that cannot be expressed as a pressure, $q=\vec{S}\cdot\vec{V}$ is a volume velocity source, and $\vec{S}$ is a cross-sectional area. While Equations 3 and 4 appear very different, they both represent the same behavior. For example, a velocity potential can be defined as, $$\vec{V}=\nabla\phi \quad \text{(Eqn. 5)}$$

where:

$$P = -\rho_0 \frac{\partial \phi}{\partial t} \quad \text{(Eqn. 6)}$$

Both pressure and velocity are derivable from the same equation, confirming that they represent a single solution. Since $\vec{V}$ and P have continuous partial derivatives, these equations may be combined to relate velocity to pressure as shown in Equation 7 below.

$$\rho_0 \frac{D\vec{V}}{Dt} = -\nabla P + \vec{F}_b \quad \text{(Eqn. 7)}$$

The volume velocity terms given in Equations 3 and 4 are significant in an Acoustic musical instrument. The volume velocity accounts for mass entering or leaving the system. At low frequencies, Acoustic guitars, for example, have a breathing mode, in which air enters and exits the Acoustic guitar through an orifice in its body called a "sound hole." As per Equation 3, $\vec{V} \cdot \vec{F}$ accounts for input forces. Ordinarily, the wood that comprises Acoustic string instruments is not perfectly rigid and resonates along with the instrument. The oscillation of the wood forces air surrounding it to move and is, in part, how sound is transferred from the body of the instrument to the air inside of it.

In contrast, the governing equations for Electromagnetic fields in linear isotropic media, in wave equation form, are shown below as Equations 8 and 9.

$$\left(\nabla^2 - \frac{1}{c_e^2}\frac{\partial^2}{\partial t^2}\right)\vec{E} = \frac{\mu \partial \vec{J}}{\partial t} - \nabla \frac{\rho}{\varepsilon} \quad \text{(Eqn. 8)}$$

$$\left(\nabla^2 - \frac{1}{c_e^2}\frac{\partial^2}{\partial t^2}\right)\vec{B} = -\nabla \times \mu \vec{J} \quad \text{(Eqn. 9)}$$

In Equations 8 and 9. $\vec{E}$ and $\vec{B}$ are the same entity described above, $c_e$ is the speed of light, μ and ϵ are the permeability and permittivity of the space, $\vec{J}$ is the free current density, and ρ is the free charge density.

Comparing Equations 3 and 8, one skilled in the art could appreciate an association between q and $\vec{J}$. Many have noted this association between pressure and electric fields, including Blackstock, who employs a similar analogy in developing a prescriptive description of Helmholtz resonators using electric circuits. Both q and $\vec{J}$ represent comparable physical actions in these equations, that is, the addition or subtraction of volume mass velocity and volume charge velocity.

Additionally, one skilled in the art could also appreciate an association between $\vec{\nabla} \cdot \vec{F}$ and $$\nabla \frac{\rho}{\varepsilon}$$

Equations 3 and 8. An increase in charge density results in a greater electric field, just as an increase in external force leads to a corresponding increase in pressure. These associations do not require that a given Acoustic source be numerically equivalent to the corresponding Electromagnetic source, but rather that the sources serve similar functional behavior. One significant difference is that the application of the ∇ operator between $\vec{F}$ and $$\frac{\rho}{\varepsilon}$$

is a reflection that $\vec{E}$ is a vector field (magnitude and direction), while pressure is a scalar (magnitude) field.

Even when Electromagnetic and Acoustic fields are described by similar terms in similar equations, it is insufficient to ensure a correspondence between the Acoustic and Electromagnetic fields. That is, the solution of a wave equation is very dependent upon the boundary conditions. Two fields described by the same equation but with different boundary conditions do not have the same solutions. Generally, the pressure field does not have a boundary condition amenable to a solution. For the velocity field, the normal component must go to zero at a rigid surface, which is the same boundary condition imposed upon $\vec{B}$ at an ideal conductor.

Accordingly, this equivalence of boundary conditions implies a correlation between Magnetic fields and Velocity fields, even though their equations are different. For example, the tangential component of $\vec{E}$ goes to zero at an ideal conductor, a boundary condition not found in Acoustic systems. This additional boundary condition is, in part, responsible for an additional class of frequencies at which Electromagnetic Musical Instruments resonate, as compared to Acoustic Musical Instruments. Thus, the association of Electromagnetic fields and Acoustic fields is not a perfect correlation. Moreover, highly similar equations can be developed between $\vec{E}$ and P, with equivalent boundary condition disparity between $\vec{B}$ and $\vec{V}$.

Further, Electric and Magnetic fields are not entirely independent. For example, Maxwell's Equations state the relationships shown in Equations 10 and 11 below.

$$\vec{\nabla} \times \vec{E} = \frac{\partial \vec{B}}{\partial t} \quad \text{(Eqn. 10)}$$

$$\vec{\nabla} \times \vec{B} = \frac{\partial \vec{E}}{\partial t} \quad \text{(Eqn. 11)}$$

Maxwell's Equations allude to the case for an Acoustic field shown in Equation 7 above.

Thus, the pressure-similar equation of the Electric field influences the Magnetic field which, in turn, exhibits velocity-like boundary conditions that influence the Electric field. However, because both Acoustic and Electromagnetic fields are capable of non-linear behavior, it which excludes the assumption that every possible Acoustic behavior is found in an Electromagnetic equivalent. This exclusion does not limit the fact that certain Acoustic properties can be comparable to certain behaviors of Electromagnetic fields.

One example in particular compares the normal modes of a closed resonant cylinder with the normal modes of a rigid ideal conductor. The normal modes of both systems are source-less solutions, amenable to an analytic answer. While the details of the derivations are within reach to one skilled in the art, and are therefore omitted, a description of certain key points is illuminating.

In the case of the closed resonant cylinder, the simplest derivation describing the Acoustic field employs the Velocity Potential formulation. Enforcing the boundary condition $$\frac{\partial \phi}{\partial n} = 0$$

at all boundary walls yields the following solution shown below as Equation 12.

$$\phi_{mnN} = A_{mnN} J_m\left(\alpha'_{mn}\frac{r}{a}\right)\cos(m\theta - \theta_{0m})\cos\frac{N\pi z}{L}e^{-i\omega t} \quad \text{(Eqn. 12)}$$

In Equation 12, m, n, and N label the resonant mode, $J_m$ is the Bessel function, $\alpha_{mn}'$ is the $n^{th}$ zero of $J_m'$, a is the radius of the cylinder, and L is its length (along $\hat{z}$). The angular frequency of this resonance is given by the relationship shown in Equation 13 below.

$$\omega_{mnN} = c_a\sqrt{\left(\frac{\alpha'_{nm}}{a}\right)^2 + \left(\frac{N\pi}{L}\right)^2} \quad \text{(Eqn. 13)}$$

The velocity along $\hat{l}$ may be obtained by differentiation along l, yielding the relationships shown in Equations 14, 15, and 16 below.

$$\vec{V}_{zmnN} = A^z_{mnN} J_m\left(\alpha'_{mn}\frac{r}{a}\right)\cos(m\theta - \theta_{0m})\sin\frac{N\pi z}{L}e^{-i\omega t} \quad \text{(Eqn. 14)}$$

$$\vec{V}_{rmnN} = A^r_{mnN} J'_m\left(\alpha'_{mn}\frac{r}{a}\right)\cos(m\theta - \theta_{0m})\cos\frac{N\pi z}{L}e^{-i\omega t} \quad \text{(Eqn. 15)}$$

$$\vec{V}_{\theta mnN} = A^\theta_{mnN} J_m\left(\alpha'_{mn}\frac{r}{a}\right)\sin(m\theta - \theta_{0m})\cos\frac{N\pi z}{L}e^{-i\omega t} \quad \text{(Eqn. 16)}$$

In Equations 14, 15, and 16 n, N=1, 2, 3 . . . and m=0, 1, 2 . . . . If, instead of rigid radial walls, there was no wall (or other pressure release surface), then the corresponding resonant frequencies would utilize $\alpha_{mn}$ rather than $\alpha_{mn}'$. Thus, the pressure release surfaces, at low frequencies, enforce the boundary condition P=0.

In the Electromagnetic case, describing the normal modes of a rigid ideal conductor is not quite as simple. In particular, there are two linearly independent resonant modes: Transverse Electric ($E_z$=0) modes and Transverse Magnetic ($B_z$=0) modes. The resonant waveform of the Magnetic Induction field in the Transverse Electric mode has the same form as the Velocity field inside the closed drum of the Acoustic example above as shown in Equations 15, 16, and 17 below.

$$\vec{B}_{zmnN} = \mu A^z_{mnN} J_m\left(\alpha'_{mn}\frac{r}{a}\right)\cos(m\theta - \theta_{0m})\sin\frac{N\pi z}{L}e^{-i\omega t} \quad \text{(Eqn. 15)}$$

$$\vec{B}_{rmnN} = \mu A^r_{mnN} J'_m\left(\alpha'_{mn}\frac{r}{a}\right)\cos(m\theta - \theta_{0m})\cos\frac{N\pi z}{L}e^{-i\omega t} \quad \text{(Eqn. 16)}$$

-continued $$\vec{B}_{\theta mnN} = A^\theta_{mnN} J_m\left(\alpha'_{mn}\frac{r}{a}\right)\sin(m\theta - \theta_{0m})\cos\frac{N\pi z}{L}e^{-i\omega t} \quad \text{(Eqn. 17)}$$

Further, the resonance frequencies are the same up to a constant, which is the ratio of the wave speeds, as shown in Equation 18 below.

$$\omega_{mnN} = c_e\sqrt{\left(\frac{\alpha'_{nm}}{a}\right)^2 + \left(\frac{N\pi}{L}\right)^2} \quad \text{(Eqn. 18)}$$

Thus, while the precise solutions are not shown, one skilled in the art will understand that the Transverse Magnetic field resonates at the same frequencies (up to the constant) as the Acoustic closed resonant cylinder with pressure release radial walls. The spatial dependence of $E_z$ is equivalent to the Acoustic pressure field inside the cavity.

However, the Transverse Electric modes are not purely comprised of Magnetic fields. One skilled in the art will understand that there is a non-zero electric field along the $\hat{r}$ and $\hat{\theta}$ directions. These components do not readily correspond to Acoustic solutions, and neither do the magnetic transverse components in the Transverse Magnetic mode.

Furthermore, a generally excited Electromagnetic cavity will oscillate in both Transverse Magnetic and Transverse Electric fields. Thus, Electromagnetic cavities can be described in one model as simultaneously Acoustically "closed" and Acoustically "open." Given that Electromagnetic fields are musical, these new waveforms represent new musical sounds. In particular, audio samples using frequencies for both the Transverse Electric and Transverse Magnetic modes as applied to a drum have been found to be significantly more harmonious than in the Acoustic case. Generalizing to other instrument shapes, Electromagnetic instruments can exhibit a full, harmonious, and beautiful sound.

Acoustic Musical Instruments can serve as a guide in understanding Electromagnetic Musical Instruments according to the present disclosure. For example, the behavior of air inside string Acoustic Musical Instruments can be described with respect to two distinct resonance characteristics, Helmholtz resonance and waveguide resonance, as one skilled in the art will understand.

Generally, Helmholtz resonance is sometimes referred to as "wine bottle" resonance. When air passes or is blown over the tip of a wine bottle, a sound is produced at a particular audible frequency. The length and area of the neck of the bottle, together with the volume of the bottle, determine which particular audible frequency, or "note," is produced. Removing wine (or whatever liquid, if any, is in the bottle) from the bottle increases the available volume, which lowers the resonant frequency and therefore the note that is produced.

In the case of a wine bottle, there are no harmonics, and the wavelength of the sound heard is typically too large to fit entirely within the bottle itself. Generally, Acousticians can prescriptively describe this behavior using resistive inductor capacitor (RLC) circuits. In Acoustic Musical Instruments, the sound hole can be modeled as an inductor while air inside the instrument body can be modeled as a capacitor. This circuit prescription is very effective in solving Acoustic problems when wavelengths are too large to fit inside a resonator.

Generally, waveguide resonance occurs when Acoustic wavelengths are small enough to fit entirely inside an enclosure through which the Acoustic waves pass. In fact, the normal modes investigated above for the resonant closed cylinder exploited waveguide resonance. However, the physical response of an enclosure is determined by assuming appropriate boundary conditions and looking for equations that solve both the wave equation and the assumed boundary conditions. The boundary conditions at rigid surfaces have been described above. One skilled in the art will understand, however, that boundary conditions at rigid surfaces are not the only boundary conditions inside an Acoustic instrument body. For example, the sound hole, which enables Helmholtz resonance and allows audible music, is a frequency dependent impedance boundary condition.

Impedance boundary conditions can also be described. One simple example is an incoming plane wave incident upon an impedance boundary surface of finite thickness. Common examples of this scenario include mass density changes such as the interface between air and a wall, cross-sectional area changes such as the interface between a one-inch pipe and a two-inch pipe, and/or a combination of mass density and cross-sectional area transitions.

As before, a solution to this problem is tied to the assumed boundary conditions. The pressure and the normal component of velocity are taken to be continuous across each interface. If cross-sectional changes are involved, then the volume velocity, $Q=\vec{V}\cdot\vec{S}$, where $\vec{S}$ is a cross-sectional area, must also be continuous.

The ratio of transmitted amplitude and incident amplitude, representing the influence of an intermediate layer of thickness $\vec{l}$, can be described as shown in Equation 19 below.

$$\frac{A_T}{A_I} = \frac{4}{\left(1+\frac{Z_1\cos\theta_2}{Z_2\cos\theta_1}\right)\left(1+\frac{Z_2\cos\theta_3}{Z_3\cos\theta_2}\right)e^{-i\vec{k}_3\cdot\vec{l}} + \left(1-\frac{Z_1\cos\theta_2}{Z_2\cos\theta_1}\right)e^{-i\vec{k}_4\cdot\vec{l}}} \quad \text{(Eqn. 19)}$$

In Equation 19, $Z_m$ is the specific Acoustic impedance $$\left(Z=\frac{P}{\vec{V}\cdot\vec{n}}\right)$$

in medium m. Similarly, cos $\theta_m$ indicates the angle between the direction of acoustic propagation and the normal of the interface within medium m.

If the intermediate medium is short compared to the wavelength of radiation, then normal incidence $$\frac{A_T}{A_I}$$

reduces to the relationship shown by Equation 20 below.

$$\frac{A_T}{A_I} = \frac{2Z_1}{2Z_1 + j\omega m} \quad \text{(Eqn. 20)}$$

In Equation 20, j=−i. This is the same equation as a resistive inductor circuit, where the output is taken across the resistor. The circuit has inductance m and resistance $2Z_1$. This is where the inductance found in Helmholtz resonance arises. A low frequency generalization to an impedance boundary where cross-sectional areas also change replaces $Z_m$ with $$\frac{Z_m}{S_m},$$

where $S_m$ is the magnitude of cross-sectional area of surface m.

In an Acoustic scenario, capacitance (Acoustic Compliance) arises due to the resistance of gas in the instrument body as the result of an increase or decrease in Pressure. A closed cavity of any shape can be described with a capacitance as shown in Equation 21 below.

$$C_{ac} = \frac{V}{\rho_0 c_a^2} \quad \text{(Eqn. 21)}$$

In Equation 20, V is the volume of the cavity.

The capacitance of the cavity is linked to the outside environment through sound holes in Acoustic Instruments. Since outgoing radiation (sound) created in the body (capacitor) must travel through the sound hole (inductor), they can be described as connected in series. It is the interplay of these two elements that gives most Acoustic string instruments their sound.

The behavior of the materials that comprise Acoustic Musical Instruments is also important to understanding the musicality of sound created by these instruments. For example, the wood that comprises many string Acoustic Musical Instruments can be approximately described as a thin plate as shown by Equation 22 below.

$$D\nabla^2\nabla^2 y + \rho h\frac{\partial^2 y}{\partial t^2} = F_y \quad \text{(Eqn. 22)}$$

In Equation 22, D is a function that depends upon the material in question, ρ is mass density, h is the thickness of the plate, F is the external force per unit area, and y is displacement. Wood, however, has a complex structure that makes it generally difficult to model.

Membranes used in Acoustic drum heads and banjos can be described by the relationship shown in Equation 23 below.

$$\nabla^2 y + \frac{\rho}{T}\frac{\partial^2 y}{\partial t^2} = \frac{F_y}{T} \quad \text{(Eqn. 23)}$$

In Equation 23, T is tension. Membranes can be described analogously to thin plates, albeit with different resonate waveforms.

For most Acoustic string instruments, the vibration of strings played by a musician drives membranes or plates. These plates or membranes resonate based upon geometry and material properties. The resonance of these plates induces radiation inside the Acoustic Instrument cavity. The force of the place or membrane can be described as a pressure, so the behavior of the gas induced by the plate or membrane may be considered source-less, assuming a spatial and time-dependent pressure boundary condition. With the addition of a sound hole though, mass may enter or exit the system. Therefore, at the sound hole, the equation describing the behavior of the gas must take this mass source into account.

Characteristics of Electromagnetic Musical Instruments

Having thus described some of the foundational behavior of Acoustic Musical Instruments, some characteristics of Electromagnetic Musical Instruments according to one embodiment of the present disclosure are now introduced. In the following discussion, certain elements of one or more embodiments of an EM Musical Instrument are introduced generally, with particular examples provided in conjunction with a specific EM Musical Instrument and illustration. It should be understood that the features can also be incorporated into other types of EM Musical Instruments than the ones expressly illustrated herein.

Generally, the behavior of Electromagnetic waveguides is similar to Acoustic waveguides. For example, the phase speed of radiation inside either Acoustic or Electromagnetic waveguides has the same form as shown in Equation 24.

$$v_P = \frac{c}{\sqrt{1 - \frac{\omega_{mn}}{\omega}}} \quad \text{(Eqn. 24)}$$

In two-dimensional Electromagnetic waveguides, or three-dimensional Electromagnetic waveguides with one dimension significantly smaller than the other two, only Transverse Electric modes are supported. The Magnetic field in this mode has the exact same form as Acoustic Velocity waves, and as such two-dimensional waveguides can be used to study Acoustic behavior. Where the waveguide restrictions are relaxed, both possible Electromagnetic modes are excited and there is additional novel musical behavior.

For example, Electromagnetic resonant cavities or waveguides can be modified to produce behavior similar to Acoustic Musical Instruments. One such modification is an Electromagnetic "sound hole." This sound hole can be created by removing a segment of a standard waveguide, similar to how a sound hole is created in an Acoustic instrument. Thus, the changes in the geometry of an Electromagnetic waveguide conductive face results in an impedance mismatch in a process similar to the change in impedance due to Acoustic waveguide changes.

Generating an equivalent Acoustic impedance mismatch due to changes in mass density requires the use of Electromagnetic materials such as, for example, a microwave ferrite. Ferrites are generally high frequency materials with a $\mu$ and $\epsilon$ (permeability and permittivity) that differ from the free space values. Ferrites are commonly employed to absorb unwanted radiation, although low-loss ferrites also exist and can be used to add induction. For example, NickelZinc is a microwave ceramic that has low loss formulations and operates well at microwave frequencies.

Understanding the impedance mismatch effect of various materials is aided by an understanding of the behavior of incident radiation on the material. For example, for the behavior of incident radiation on an Electromagnetic material of finite thickness, the overall transmission factor is given by Equations 25 and 26 below.

$$\frac{\vec{E}_{05}}{\vec{E}_{01}} = \frac{4}{\left(\left(1 + \frac{Z_I\cos\theta_{II}}{Z_{II}\cos\theta_I}\right)\left(1 + \frac{Z_{II}\cos\theta_{III}}{Z_{III}\cos\theta_{II}}\right)e^{-i\vec{k}_3\cdot\vec{l}} + \left(1 + \frac{Z_I\cos\theta_{II}}{Z_{II}\cos\theta_I}\right)\left(1 + \frac{Z_{II}\cos\theta_{III}}{Z_{III}\cos\theta_{II}}\right)e^{-i\vec{k}_4\cdot\vec{l}}\right)} \quad \text{(Eqn. 25)}$$

$$\frac{\vec{E}_{05}}{\vec{E}_{01}} = \frac{2(1 + \cos\theta_{II})}{\left(\left(1 + \frac{Z_I\cos\theta_{II}}{Z_{II}\cos\theta_I}\right)\left(1 + \frac{Z_{II}\cos\theta_{III}}{Z_{III}\cos\theta_{II}}\right)e^{-i\vec{k}_3\cdot\vec{l}} + \left(1 + \frac{Z_I\cos\theta_{II}}{Z_{II}\cos\theta_I}\right)\left(1 + \frac{Z_{II}\cos\theta_{III}}{Z_{III}\cos\theta_{II}}\right)e^{-i\vec{k}_4\cdot\vec{l}}\right)} \quad \text{(Eqn. 26)}$$

Equation 25 reflects behavior when the Magnetic field is transverse to the materials interface, while Equation 26 reflects behavior when the Electric field is transverse to the plane of incidence. Assuming normal incidence, $Z_I = Z_{III}$, and that the middle material is of higher impedance, in the long wavelength limit both of these equations become ultimately relate to Equation 27 below.

$$\frac{\vec{E}_{05}}{\vec{E}_{01}} = \frac{2Z_I}{2Z_I - iZ_{II}\omega\sqrt{\mu\varepsilon_{II}}l} \quad \text{(Eqn. 27)}$$

Here, $Z_n$ is Electromagnetic impedance and, in infinite space, is equal to $-Z_n = \sqrt{\mu/\epsilon}$. Again it is shown that this impedance relationship reacts like an inductor for long wavelengths. This inductance can be varied by changing the geometry of the sound hole, or by using different Electromagnetic materials for the Electromagnetic version of the sound hole.

Further, it is shown that the Electromagnetic equivalent to Acoustic impedance mismatches due to changes in mass density involves changes in the values of $\mu$ and $\epsilon$. Additionally, the Electromagnetic impedance has a different relationship based upon polarization. Different impedance relationships imply different boundary conditions and therefore different behavior. Thus, Electromagnetic Musical Instruments exhibit a different sound based on the polarization of the radiation, and one may selectively listen to different behaviors by selectively measuring and/or exciting particular polarizations.

The impedance mismatch due to a sound hole in a conductive face is not easy to calculate. A full treatment, for both Acoustic and Electromagnetic fields, requires computing the Diffraction effects of the sound hold close to the sound hole. The presented equations reflect behavior of Electromagnetic fields in an ideal environment (e.g., infinite space) and can indicate behavior found in more complicated situations, such as, for example, a hole in a waveguide wall.

This generalization can be achieved by incorporating all of the complicated behavior into the impedance functions $Z_n$. These new generalized impedance functions may be non-local in both space and time. While the exact dependence of impedance for both Acoustic and Electromagnetic fields in any given situation may not be identically equivalent, how those impedances relate to each other to determine transmission amplitude is found to be highly similar between Acoustic and Electromagnetic fields.

In an Acoustic Musical Instrument, the inductance of the sound hole along with the capacitance of the body leads to Helmholtz resonance. Generally, instituting Helmholtz resonance in an Electromagnetic waveguide also requires inductance and capacitance. Standard Electromagnetic cavities have intrinsic inductance and capacitance due to geometry. However, these values typically lead to waveguide resonance.

As the Helmholtz resonance in Acoustic Musical Instruments is below the waveguide cutoff frequency, the inductance and capacitance of a standard Electromagnetic cavity should be increased to allow resonance at lower frequencies. As described above, inductance can be added through incorporation of a sound hole in a waveguide. However, to achieve a desired frequency response, this resonance may require tuning, which in one embodiment can be accomplished by modifying the resonant cavity's inductance and/or capacitance. In one embodiment, modifying the inductance can be achieved through modifying the sound hole.

Modifying the capacitance can be achieved by, in one embodiment, electrically isolating one section of a cavity from the rest of the cavity. In another embodiment, a small plate can be coupled to the end of a screw, which is coupled to a wall inside the cavity. Turning the screw increases or decreases the distance of the plate from the other conductive walls, thereby changing the capacitance of the cavity as a whole and, further, allowing fine-tuning.

In an alternate embodiment, a non-magnetic slug can be added to the Electromagnetic Musical Instrument body, in a region with a large density of Magnetic Induction lines, to vary inductance. In an alternate embodiment, changing the distance that separates two electrically separated waveguide segments can also modify the capacitance. One skilled in the art will understand that other configurations can also be employed.

Additionally, Helmholtz resonance in a cavity shape is not required to enable musical behavior. However, Helmholtz resonance can be instituted at a frequency above the waveguide cutoff frequency, in which case the Electromagnetic Musical Instrument's fundamental frequency would be the lowest waveguide resonance frequency. Thus, the greater versatility of Electromagnetic systems allows for a wider variety of musical instruments than are currently possible in Acoustic Musical Instruments.

As described above, Helmholtz resonance in Acoustic instruments occurs below the Acoustic waveguide cut-off frequency. Resonance below an Electromagnetic waveguide's cutoff frequency requires Transverse Electromagnetic (TEM) modes, so TEM modes in Electromagnetic waveguides can be used to generate musical behavior. TEM modes are essentially electrostatic in nature and operate at all frequencies. TEM modes, however, require a potential difference within the resonant cavity, which cannot occur if all conductive faces are electrically connected at the same potential. A sound hole is, in part, the absence of a conductor and is therefore not necessarily at the same potential as the rest of the conductor. Thus, in one embodiment, the addition of a sound hole alone can allow for TEM modes.

Also, in Acoustic string musical instruments, the lowest mode, or "breathing mode," occurs when the top plate and back plate are oscillating out of phase with each other. This action draws air in and out of the instrument. Equating oscillations of instrument plates with oscillations of charge density, a similar effect can be achieved through out-of-phase oscillation of charges on opposite conductive faces. A sound hole alone will not achieve this result, as the conductive faces are at the same potential, and thereby oscillate in phase. However, by electrically isolating, for example, a front conductive face and a back conductive face, charges on the two faces can oscillate out of phase. By removing their electrical connection, the two plates can be at different potentials, reinforcing TEM modes. This potential difference will not destroy waveguide resonances, and moreover, the above electrical disconnection is not necessary to the musicality of Electromagnetic Musical Instruments. Instead, it merely enables qualitative behavior that is similar, in part, to Acoustic Musical Instruments. Particularly where an Electromagnetic Musical Instrument is not constructed like an Acoustic Musical Instrument, new sounds can be created.

Further, the details of construction determine the value of the capacitance obtained by isolating different elements of a waveguide. There is no limit to how many sections may be isolated; an Electromagnetic Musical Instrument can be electrically subdivided into two or 10,000 subunits or any other number of subunits. Each configuration exhibits its one unique tone.

Changing the geometry of the electrically separated sections can also create other different tones. Some elements can even be selectively grounded. For example, Electromagnetic fields can be appropriately described using potentials. A ground plane enforces the ground boundary condition ($\Phi=0$), which is roughly equivalent to the Acoustic case of fixing the end of a string or plate such that the string or plate is unable to move and/or vibrate freely. While a ground plane does not prevent charge oscillation, the ground condition affects how the charges can oscillate. Similarly, one or more elements can be maintained at a constant potential, as one skilled in the art will understand.

Thus modified as described above, a standard Electromagnetic resonant cavity can support Helmholtz resonance. A further modification entails selecting a "musical" shape for the waveguide. Shapes known to produce good Acoustic Musical. Instruments can also be employed to create Electromagnetic Instruments. Suitable musical shapes include, for example, guitars, cellos, and violas, among others. Further, non-traditional musical shapes can also be employed, such as, for example, spheres, cones, and the confocal paraboloid. The confocal paraboloid in particular is experimentally known to produce chaotic solutions, and when configured as an EM Instrument, can generate interesting Electromagnetic musical effects.

Source effects also play a role in the sound of Electromagnetic Musical Instruments. Generally, certain regions over which sources act in Electromagnetic systems vary from their analogous region in Acoustic systems. For example, Acoustic membranes and plates driven by strings involve a Force source term. If an Electromagnetic conductor is excited with an external charge and current source, then its response also includes both charge and current source terms. Just outside this conductor, the Electromagnetic fields involve no additional sources, in a similar manner as Acoustic fields outside plates and membranes involve no additional source terms. However, within an Acoustic sound hole, the Acoustic field involves a volume velocity, while an Electromagnetic sound hole has no charges or currents, and therefore no source terms. This difference indicates a significant functional difference between sound holes in Acoustic and Electromagnetic Musical Instruments.

But Babinet's Principle of Complementary Screens states that the field due to the interaction of a thin, perfectly-conducting screen with a section removed from the screen is exactly the same (apart from polarization) as if the conducting screen were absent and the cut-out was replaced with a conductor. Accordingly, the radiated field from an Electromagnetic sound hole acts as if it were a conductor and contained sources.

Babinet's principle does not apply to the fields created by the charges (incident fields) within and around the Electromagnetic Musical Instrument, only the interaction of these fields with the sound hole. This implies that the sources correlated in a conductor to the sources within an Acoustic plate or membrane apply, while at the same time, Babinet's principle can be used to correlate volume velocity sources in Acoustic sound holes to fictitious sources in Electromagnetic sound holes. While these sources do not exhibit the exact same behavior, both fields have sources in the same places.

So far the Electromagnetic Musical Instruments described involve the use of resonant cavities, that is, conductors enclosing a region of empty space. However, Electromagnetic Musical Instruments can be configured more generally. Any difference in electromagnetic properties, particularly $\mu$ and $\epsilon$, is sufficient to define an Electromagnetic boundary. Thus, for example, a solid piece of Electromagnetic substance in the shape of an Acoustic guitar can be configured as an Electromagnetic Musical Instrument.

Further, the possible presence of volume currents and/or volume polarization indicates different behavior, and different musical behaviors are desirable. Additionally, the material itself may have resonances within the band of frequencies at which it is excited, and these atomic/molecular behaviors affect the resultant sound. Plasmas can also be employed, allowing creation of both sound waves and Electromagnetic waves within the same medium. Moreover, some materials respond non-linearly to applied fields, so using non-linear materials will also produce significantly different tones. One skilled in the art will understand that a wide variety of combinations and mixtures are available for the construction of an Electromagnetic Musical Instruments.

Further, plasmas in particular can be employed to create interesting Electromagnetic Musical Instruments. Thus, both sound waves and Alfvén waves, or "MagnetoHydrodynamic (MH) waves," can be generated within the same medium. With judicious selection of plasma parameters (e.g., density and temperature) and an external magnetic field, both Alfvén and Acoustic waves can be generated at similar frequencies. Temperature influences the sound speed and the conductivity of the plasma, while density and magnetic flux intensity determine Alfvén speed. Thus, the parameters can be selected such that the resultant Alfvén waves and Acoustic waves propagate with comparable velocities. Further, given the complex geometry of a typical musical instrument, Alfvén waves can incidentally generate sound waves, and sound waves can incidentally generate Alfvén waves.

As described above, MH behavior requires an external magnetic field within and around the EM instrument. In one embodiment, this magnetic field is generated via a loop of current configured around a sound hole. A constant current maintains the magnetic flux and keeps the plasma in the "frozen in" condition, as one skilled in the art will understand. Alfvén waves can be then induced through the small current loop to excite magnetic field perturbations perpendicular to the static field. In an alternate embodiment, a loop of current can be configured independent of a sound hole. That is, magnetic field perturbations can be generated at any point on the EM Instrument. Further, the magnetic field perturbations can be generated through a variety of methods other than a loop of current, as one skilled in the art will understand. In some embodiments, the magnetic field perturbations can be configured as an integral part of the sound of the EM Instrument, providing additional novel musical behavior.

As an aside, the same frequency conversion methods for EM Instruments, described in more detail below, also apply in this case. However, it is possible to get an Alfvén wave velocity comparable to the speed of sounds found in ordinary observance. This correspondence would naturally create the correct, suitable wavelengths, and therefore frequency conversion would not be necessary.

A sound hole current creates a magnetic field in accordance with the right hand rule, into and away from the instrument body. As magnetic fields must form closed loops, any magnetic fields directed into the instrument must come back out of the instrument to form a closed loop. However, a sound hole current as described above does not readily support magnetic flux in two directions. Though not strictly necessary, a separate region of the instrument should be configured to allow magnetic flux out of the instrument. In one embodiment, the sound hole current radius is configured smaller than the sound hole radius. The inner circle (as defined by current) generates flux in one direction, while the remaining area allows flux to leave in the opposite direction. However, the flux leaving the instrument will cause a current in the surrounding conductive elements, which will resist flux entering the instrument.

In an alternate embodiment, another sound hole can be created elsewhere in the Instrument. This second sound hole can allow magnetic flux to flow through the instrument, and its placement relative to the other sound hole will shape the sound of the instrument. In an alternate embodiment, the second sound hole can be driven with a current in the opposite direction as the first sound hole current. In an alternate embodiment, electrically separating certain parts of the instrument from the rest allows magnetic flux to flow out of the instrument through the space between the conductors. And the particular design of the separation between conductors can affect the response of the instrument. Additionally, one skilled in the art will understand that sound hole current can be realized with a single current loop or many current loops, with additional current loops increasing the magnetic flux generated.

Thus, with suitable material, plasma, and magnetic conditions, Alfvén and Acoustic waves can be induced simultaneously. As described in more detail below, audio or other input can be fed to one or more transducers located on the MH (EM) instrument. The transducers would drive Acoustic resonances while one or more current loops drive Alfvén resonances. This combination of behaviors results in a new instrument tone.

In an alternate embodiment, no correspondence between Acoustic and Alfvén wave velocity is required. Instead, an MH (EM) Instrument can be operated using sound waves or Alfvén waves. For example, an Alfvén speed comparable to sound in air can be realized in gas with a significantly different sound speed than air.

As described above, other materials than plasma can be employed in an EM Instrument. Some analogous Acoustic materials can be readily identified as suitable for EM Instruments. However, the Electromagnetic equivalent of wood, a material commonly employed to build traditional Acoustic Musical Instruments, is not readily apparent. A close analog, however, to current in a conductor is an Acoustic Membrane. Current is confined to a very small skin depth at microwave frequencies in good conductors and this thinness roughly corresponds to a thin Acoustic Membrane such as, for example, a drum membrane. Typically, most Electromagnetic waveguides are constructed using conductors that are many orders of magnitude thicker than the electrical current skin depth. Thus, a "thick" conductor roughly corresponds to a rigid Acoustic Membrane. Similarly, a relatively thick conductor can be configured to perform roughly analogous to Acoustic wood.

As used herein, "rigid" describes a material that substantially prevents radiation from passing through it. To configure a conductor to behave more like a drum membrane, that is, to allow radiation to pass through, the conductor can be configured thinner than the electrical current skin depth. One skilled in the art will understand that skin depth is a frequency dependent quantity, and therefore a thin conductor has a frequency dependent response similar to Acoustic Membranes.

The association between Electromagnetic conductors and Acoustic membranes suggests that an Electromagnetic guitar constructed out of high conductivity conductors can be modeled as resembling an Acoustic guitar made entirely out of membranes. As Acoustic materials have a significant impact on the sound of an instrument, an Electromagnetic guitar-shaped instrument can have a significantly different tone and sound than a traditional Acoustic guitar.

Moreover, one skilled in the art will understand that current in a conductor is proportional to the Transverse Electric field within in it, and comparison of the Membrane equation and the Electric field equation reveal different source terms. Conductors do not behave exactly like membranes, although the association enables a mental framework for understanding the musical behavior of conductors.

Furthermore, any conductive material can be employed to construct an Electromagnetic instrument body. As skin depth is proportional to conductivity, a relatively poor conductor allows for volume currents and new instrument behavior. The conductivity of the material should be above a certain threshold, however, as too low of a conductivity would dampen the response of the Electromagnetic instrument.

In some instances, Electromagnetic cousins of known Acoustic instruments can provide novel musical behavior in a manner more accessible to listeners unfamiliar with non-analogous EM Instruments. For example, Electromagnetic drums are somewhat straightforward to construct. A cylindrical shell of high conductance corresponds to the Acoustic shell. The radiation impedance mismatch that occurs at both ends of Acoustic drums can be manifested Electromagnetically by a change in waveguide dimensions. A very thin conductor can be employed as the Electromagnetic "drumhead." The skin depth of current is also dependent upon conductivity, so a less conductive, thicker material can be used to create analogous behavior to an Acoustic drumhead. One skilled in the art will understand that the skin depth in high conductivity materials for microwave frequencies is on the order of $10^{-6}$ m, which is so thin that the conductor should be deposited on a substrate. Alternatively, a thin sheet of nanotube foil can be employed as a membrane, and does not require deposition on a substrate.

As described above, EM Instruments can also be modeled on guitar-shaped Acoustic instruments. This particular modeling illustrates an important advantage of the present disclosure. In traditional Acoustic guitars, the resonant cavity requires bracing to support and strengthen the cavity. EM Instruments do not require such bracing. Thus, a brace-less EM Instrument can be configured an operated for comparison with a braced EM Instrument. The differences can offer new understanding into the effects of bracing in Acoustic guitars. While the changes in Electromagnetic musical behavior between a brace-less and a braced musical instrument are not likely to correspond exactly with the effect of bracing in Acoustic guitars, it is clear that studying such similar configuration changes in Electromagnetic Musical Instruments can advance knowledge of Acoustic systems.

Certain traditional Acoustic instruments are amenable to direct conversion to EM use. For example, traditional brass instruments are particularly simple to configure for Electromagnetic musical use. Since brass instruments are already constructed from conductive material, these instruments require very little to no modification for Electromagnetic use. Additionally, the bell at the end of many traditional brass instruments attempts to match Acoustic impedance between the instrument and free space, and this same behavior is also found Electromagnetically. While the conductive material is Acoustically rigid, it is Electromagnetically highly responsive. The increased response of the conductor offers a very different "sound" for Electromagnetic Brass instruments.

One area of interest in developing new musical behavior is modeling Electromagnetic versions of traditional Acoustic instruments. For example, while the brass instrument described above can be converted to EM use, an independently constructed EM version of a brass instrument comprises a corresponding EM version of each element of the brass instrument. Accordingly, in one embodiment, an EM "brass" instrument replaces all Acoustically active elements (e.g., valves, switches, keys, etc.) with conductive equivalents. Extrapolating to the general case, an Electromagnetic version of an Acoustic instrument can be constructed by replacing the Acoustically active elements with Electromagnetically active analogous elements.

Some Electromagnetic analogues are straightforward. For example, as described above, EM sound holes can be configured as empty holes in a waveguide. Alternatively, an EM sound hole can be filled with conductive material, as described above. Similarly, certain mechanical features of Acoustic instruments can be mirrored in the EM instrument with minor or no modification, such as, for example, the "keys" on an Acoustic saxophone. One skilled in the art will understand that other mechanical analogues can also be employed.

Some Electromagnetic analogues are less straightforward. For example, Acoustic Reed instruments operate as a function of the vibration of a thin reed-type material. The reed in a traditional reed instrument vibrates at a very high frequency, which governs the pitch of the notes the instrument can generate, and influences the shape and size of the instrument body (i.e., the Acoustic resonant cavity). Thus, the conductive EM analogue to a reed should also be flexible enough to vibrate at a very high frequency. In an alternate embodiment, the EM instrument body (i.e., the EM resonant cavity) can be configured with a size sufficient to allow access to the lower frequency range. One skilled in the art will recognize other suitable configurations.

Another configurable feature of EM Instruments is the medium that fills the EM Instrument. Typical Acoustic Instruments include a cavity that is filled with air from the local environment. An EM Instrument, however, can be filled with a variety of different materials, including, for example, plasma, dielectrics, or other materials. The effects of plasma on EM fields, as described above, offer a general case for the effects of other materials, as one skilled in the art will understand.

Further, recent advances in materials that conduct Electromagnetic radiation have generally focused on trying to ensure that the radiation behaves linearly as it travels through the material. For example, the transmission of light through fiber optic material is an important field of study in modern telecommunications. However, there is a non-linear self-phase interaction that creates new frequencies as a pulse travels down a fiber line. The speed of propagation in these fibers is frequency dependent and thus, the creation of new frequencies results in distortions of the wave shape. For digital information transmission, this distortion can result in digital bits spreading into each other's space, confusing the intended signal. From a musical standpoint, however, these non-linearities are to be embraced as they represent new musical behavior. Thus, for certain materials, perceived disadvantageous behavior in one technical field can yield advantageous novel sounds in an EM Instrument.

Having described various configurations of EM Musical Instruments generally, certain particular embodiments are now shown. While the following descriptions of various particular embodiments will refer to specific configuration details, one skilled in the art, having the benefit of the teachings herein, will understand that various other configurations can also be employed.

Electromagnetic Drum

Figure 3A:
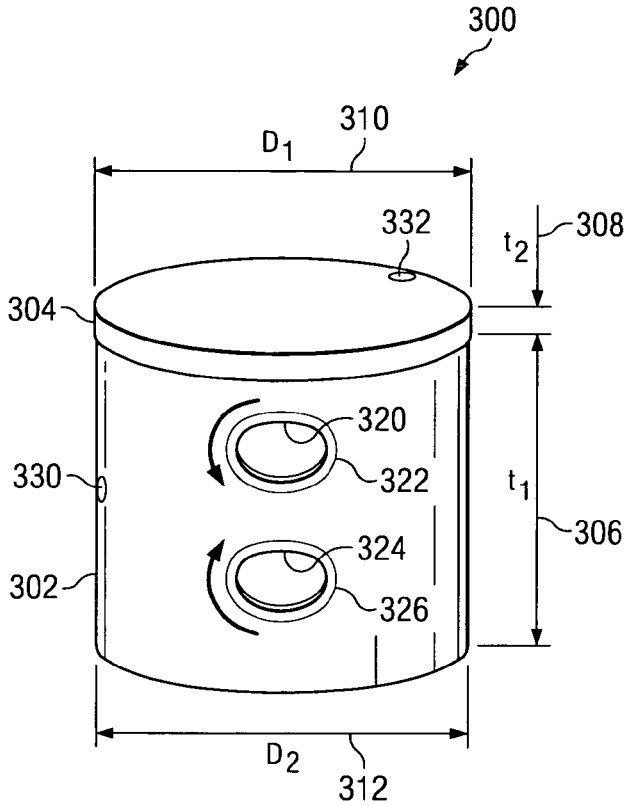
FIGS. 3A-3C are somewhat simplified block diagrams illustrating some of the features of an exemplary electromagnetic musical instrument according to one embodiment of the present disclosure.

FIG. 3A is a somewhat simplified illustration of a EM Musical Instrument 300 in accordance with one embodiment of the present invention disclosure. In particular, EM Instrument 300 is generally configured as an EM "drum."

EM Instrument 300 generally includes a conductive, cylindrical shell 302. In the illustrated embodiment, shell 302 is configured as open on both ends. In an alternate embodiment, one or both ends of shell 302 can be closed. A "thin" conductive membrane 304 is coupled to one end of shell 302. In an alternate embodiment, a membrane 304 can couple to, and thereby close, both ends of shell 302. In the illustrated embodiment, the length of shell 302, $t_1$ 306, is significantly greater than the thickness of membrane 304, $t_2$ 308. In one embodiment, the thickness $t_2$ 308 of membrane 304 is on the order of $10^{-6}$ m. In one embodiment, membrane 304 is a nanotube foil. In an alternate embodiment, membrane 304 is a conductive substance deposited on a substrate.

In the illustrated embodiment, EM Instrument 300 generally includes two sound holes, sound hole 320 and sound hole 324. In an alternate embodiment, EM Instrument 300 can include a plurality of sound holes in a variety of relative placement configurations. In the illustrated embodiment, the diameters of sound hole 320 and sound hole 324 are substantially equivalent. In an alternate embodiment, the diameters of sound hole 320 and sound hole 324 can be different.

As shown in FIG. 3A, sound hole 320 generally includes a current loop 322 and sound hole 324 includes a current loop 326. In an alternate embodiment, one or both current loops can be omitted. In the illustrated embodiment, current loop 322 is configured to generate current in a counter-clockwise direction around sound hole 320 and current loop 326 is configured to generate current in a clockwise direction around sound hole 324. One skilled in the art will understand that other configurations can also be employed.

In the illustrated embodiment, shell 302 of EM Instrument 300 is configured with a top diameter $D_1$ 310 and a bottom diameter $D_2$ 312. In the illustrated embodiment top diameter $D_1$ 310 and bottom diameter $D_2$ 312 are substantially equivalent. In an alternate embodiment, top diameter $D_1$ 310 and bottom diameter $D_2$ 312 can be substantially different.

As described above, operation or "playing" of EM Instrument 300 includes applying an excitation signal to EM Instrument 300. As described above, the location on EM Instrument 300 at which the excitation signal is applied can vary the unique musical sounds produced. In the illustrated embodiment, EM Instrument 300 is depicted with two ports configured to simplify application of the excitation signal. A port 330 is coupled to shell 302 to provide a particular location on shell 302 where an excitation signal can be applied. Similarly, a port 332 is coupled to membrane 304 to provide a particular location on membrane 304 where an excitation signal can be applied.

Figure 3B:
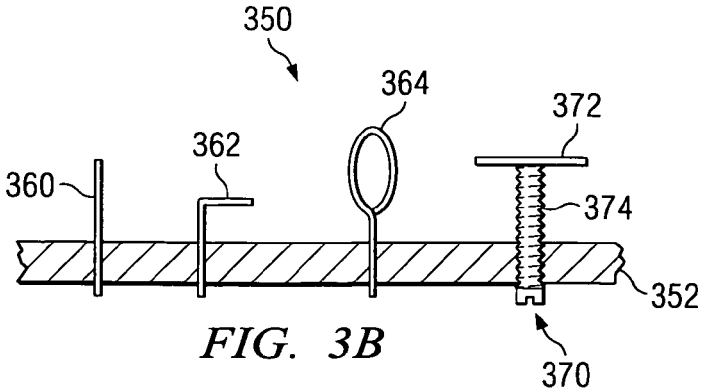

As described above, the ports can be configured in any suitable manner. Referring now to FIG. 3B, the reference numeral 350 generally designates a cutaway view of a number of ports coupled to a shell 352. A port 360 is coupled to shell 352 and is configured as a linear antenna. A port 362 is coupled to shell 352 and is configured as an L-shaped antenna. A port 364 is coupled to shell 352 and is configured as a loop-type antenna.

A port 370 is coupled to shell 352 and is configured as a variable capacitance plate antenna. In particular, port 370 includes a plate 372 coupled to a screw 374. Screw 374 can be adjusted to vary the distance between plate 372 and shell 352. In the illustrated embodiment, port 370 is also configured to apply an excitation signal to shell 352. In an alternate embodiment, port 370 can be configured solely to vary flux within the EM Instrument in which it is employed, as described above. Other suitable configurations can also be employed according to embodiments of the present disclosure.

Figure 3C:
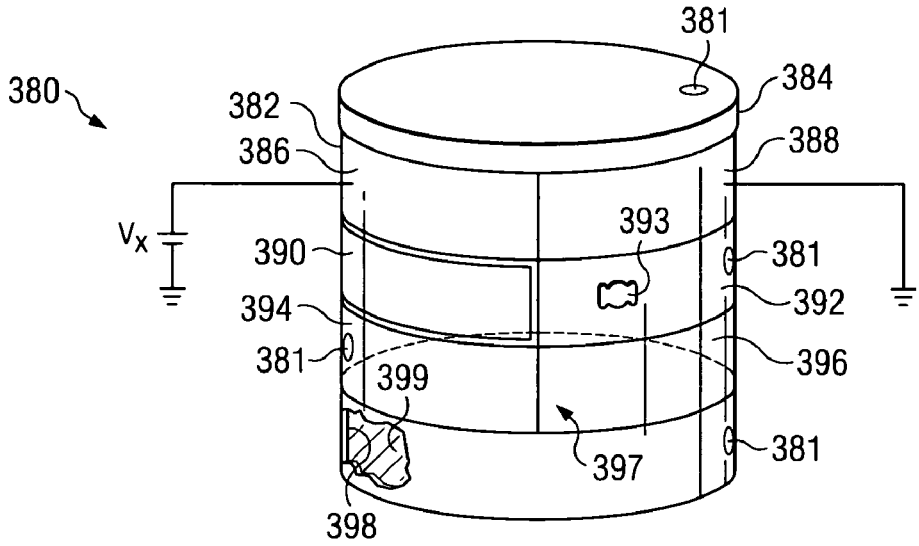

As described above, one or more sections of an EM musical instrument can be partitioned and electrically separated. Referring now to FIG. 3C, the reference numeral 380 generally designates an EM musical instrument. EM musical instrument 380 includes a shell 382 coupled to a membrane 384. Various ports 381 are coupled to EM musical instrument 380. While specific ports are shown in this and other embodiments, one skilled in the art will understand that in some embodiments a "port" is unnecessary and an excitation signal can be applied anywhere on the EM Instrument.

As illustrated, shell 382 is partitioned into seven sub-sections, which are electrically independent from each other. As described above, in an alternate embodiment, shell 382 can be partitioned into any number of sub-sections. In the illustrated embodiment, sub-section 386 is coupled to a fixed potential, $V_x$. Sub-section 388 is coupled to ground. Sub-section 390 is electrically insulated from the other sub-sections.

Sub-section 392 includes a non-magnetic metal slug 393. Sub-sections 394 and 396 together form a plate 397 that separates a cavity 398 from the rest of EM musical instrument 380. In the illustrated embodiment, cavity 398 is filled with a conductive material 399. In one embodiment, conductive material 399 is plasma.

As described above, the various sub-sections so configured are subject to varying electromagnetic responses. For example, non-magnetic metal slug 393 varies the magnetic flux lines near sub-section 392, which, as described above, changes the EM response of the EM Instrument, thereby changing the output music. Similarly, tying one sub-section to a specific potential ($V_x$ for sub-section 386, and ground for sub-section 388) also changes the output music. As such, novel musical sounds can be generated by EM musical instrument 380 through application of an excitation signal at one or more ports 381. Further, as described above, the various configurations can be further modified to yield additional novel musical sounds.

Figure 4:
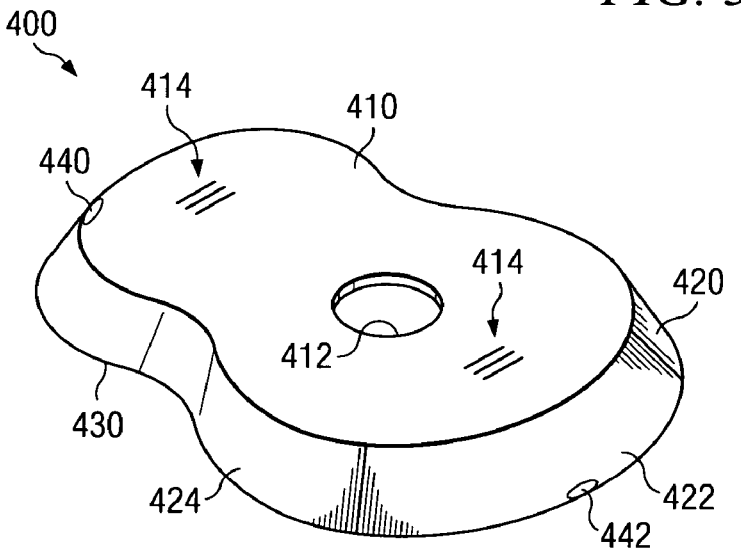
FIG. 4 is a somewhat simplified block diagram illustrating an exemplary guitar-based electromagnetic instrument according to one embodiment of the present disclosure.

Referring now to FIG. 4, another embodiment of an EM musical instrument is illustrated. Reference numeral 400 generally designates an EM musical instrument. EM musical instrument 400 includes a top plate 410. As illustrated, top plate 410 is generally guitar-shaped and includes a sound hole 412. Top plate 410 also includes a plurality of milled slot lines 414. In the illustrated embodiment, top plate 410 is shown with two sets of three slot lines 414. In an alternate embodiment, slot lines 414 can be omitted. Other suitable configurations of slot lines 414 can also be employed according to embodiments of the present disclosure.

A plurality of side plates 420, 422, and 424 are coupled to top plate 410. A bottom plate 430 is coupled to the plurality of side plates. As illustrated, bottom plate 430 is also generally guitar-shaped and comprises a larger area than top plate 410. In the illustrated embodiment, side plates 420, 422, and 424 are angled outward from top plate 410 and are configured to form a continuous body when coupled to the larger bottom plate 430. In an alternate embodiment, top plate 410 and bottom plate 430 can be of substantially similar area and shape.

Top plate 410, side plates 420, 422, and 424, and bottom plate 430 are constructed from conductive material as described above. In the illustrated embodiment, top plate 410, side plates 420, 422, and 424, and bottom plate 430 are constructed from the same conductive material. In an alternate embodiment, one or more of top plate 410, side plates 420, 422, and 424, and bottom plate 430 can be constructed out of a different conductive or non-conductive material.

In the illustrated embodiment, EM musical instrument 400 includes two ports 440 and 442. Port 440 is coupled to top plate 410 and port 442 is coupled to side plate 422. In an alternate embodiment, ports 440 and 442 can be coupled to other components of EM musical instrument 400. Further, additional ports can also be employed, as one skilled in the art will understand. Additionally, one or more features as described above with respect to FIG. 3 can also be employed in EM musical instrument 400.

Horn-Shaped EM Musical Instrument

Figure 5:
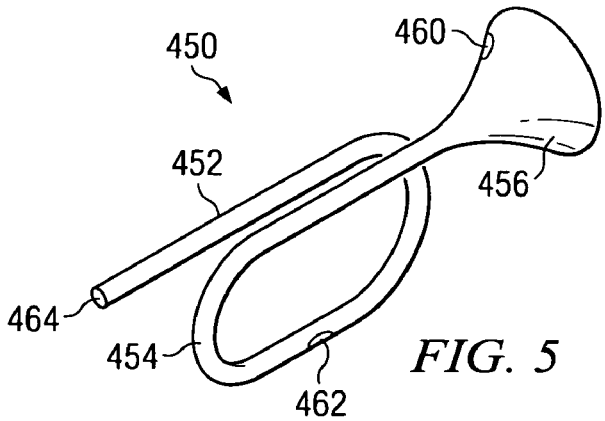
FIG. 5 is a somewhat simplified block diagram illustrating an exemplary horn-based electromagnetic instrument according to one embodiment of the present disclosure.

Referring now to FIG. 5, another embodiment of an EM musical instrument is illustrated. Reference numeral 450 generally designates an EM musical instrument. In particular, EM musical instrument 450 is a somewhat horn-shaped musical instrument.

EM musical instrument 450 is constructed out of a conductive material, such as brass, formed into a shaped cylinder 452. Shaped cylinder 452 is formed to include a loop 454 and terminates at one end in a bell 456. In the illustrated embodiment, EM musical instrument 450 is constructed out of a continuous shaped cylinder. In an alternate embodiment, EM musical instrument 450 can be constructed out of a plurality of shaped cylinders coupled together.

As illustrated, EM musical instrument 450 includes three ports configured to receive an excitation signal. Port 460 is coupled to bell 456, port 462 is coupled to loop 454, and port 464 is coupled to the end of shaped cylinder 452 distal from bell 456. It should be understood that EM musical instrument 450 could include other ports as well in accordance with embodiments of the present disclosure. Additionally, one or more of the features described above with respect to FIG. 3 can also be employed in EM musical instrument 450.

Playing or Exciting EM Musical Instruments

Generally, Electromagnetic Musical Instruments can be excited, or "played," using standard techniques for exciting waveguides, such as, for example, probes or loops, as shown in FIG. 3B. The geometry of the probe or loop determines its frequency characteristics, such as bandwidth, for example.

EM Instruments in accordance with the present disclosure are generally broadband instruments, and therefore support broadband antennae and/or multiple antennae. New instrument sounds not found Acoustically can be generated through multiple antennae (at the same or different location), each excited with a different frequency range. The EM Instrument can also be excited by applying voltage and current to the sections that comprise the EM Instrument body; in effect, using the instrument body as an antenna. As described above, certain EM Instruments exhibit a different response for different polarizations, and a polarization filter can be placed between the excitation apparatus and the EM Instrument to vary the input excitation polarization. Where the face of an EM Instrument is used as the exciting antenna, a particular polarization can be selected by milling slot lines into the instrument face, wherein the absence of conductor constrains the spatial behavior of charge, and therefore constrains Electromagnetic fields. For example, as described above, EM musical instrument 400 of FIG. 4 can include slot lines 414.

Generally, EM Instruments can be excited in a variety of ways. EM drums, for example, can be excited by applying a quick pulse to the EM membrane or shell, or can be coupled to the free space in the cavity. Any waveform can be employed for these pulses, and different waveforms will result in different sounds, as one skilled in the art will understand. Some examples include triangular, square, or sinusoidal pulses. Further, waveforms from the averaging and differentiating filters found in Wavelets can also be employed. The length of the applied pulse can also vary, with different length pulses yielding different sounds.

The location on the Electromagnetic Musical Instrument at which it is excited is also configurable. For string-type instruments, a voltage can be applied to the top plate. For brass-type instruments, which are typically excited through a velocity source, a probe or loop can be employed in one or more locations to produce different sounds. For drum-type instruments, a short pulse can be applied to the Electromagnetic membrane. Examples of multiple excitation points are shown above in conjunction with FIGS. 3, 4, and 5. It should be understood that other suitable configurations can also be employed according to the present disclosure.

As described in more detail below, waveform selection and conversion can affect the musical behavior of EM Instruments. Generally, EM Instruments can be configured to support Acoustic-type musical behavior roughly analogous to familiar Acoustic Instruments. For example, to get musical behavior out of an EM guitar the same size as an Acoustic guitar, the wavelengths by which the two instruments are excited should be the same. The difference in propagation speed between Acoustic and Electromagnetic fields, however, means that the same wavelengths are realized at different frequencies, as one skilled in the art will understand. For example, the strings that musicians play to excite Acoustic string instrument bodies resonate at frequencies generally too low to excite EM instruments directly.

Generally, the EM Instruments described herein can be excited through electrical source signals. These source signals can be derived in a number of ways. In one embodiment, the source signals are generated and manipulated directly by the EM Instrument operator. In this embodiment, the musicality of the source signals originates in the operator. In an alternate embodiment, standard Acoustic instruments are played and their sounds recorded/converted to electrical signals to generate the source signals. It should be understood that there are a number of well-known methods to capture Acoustic sounds and render electrical signals based on the Acoustic sounds. In an alternate embodiment, standard Electric instruments are played to generate electrical signals. It should be understood that there are a number of methods and systems to generate musical electrical signals suitable for input to an EM Instrument system according to the present disclosure.

Frequency Conversion in EM Instruments

Some systems generate musical electrical signals that must be converted for EM Instrument use. For example, conventional musical systems are directed towards the audible frequency range. As described above, signals at the audible frequency range are generally ineffective in driving EM Instruments directly. Further, while an EM Instrument can generate audible sounds, the full EM Instrument output may not be within the audible frequency range. Unlike Acoustic Instruments, there is no specific frequency range for EM Instruments—EM radiation is inaudible and any frequency regime appropriate to the EM Instrument size may be used.

While this feature represents one advantages of the present disclosure, the resonance output of the EM Instrument is converted to audible output, in a user-determinable process described in more detail below. Accordingly, most EM Instrument systems according to the present disclosure, both input to and output from the instrument will be frequency converted. In other words, generally, the input audio source signal is converted, and this converted source signal is used to excite the EM Instrument. The EM Instrument output is frequency converted to the audible frequency range for listening.

While EM Instruments can generate response output at any number of frequencies, if behavior analogous to an Acoustic Instrument is desired, the EM Instrument size should be scaled to maintain the same body-size-to-wavelength ratio, as described above. For equivalently sized Acoustic and EM Instruments, the appropriate frequency range is approximately 20 MHz-20 GHz. This frequency range typically requires a frequency multiplication factor ($c_e/c_a$) of about 882,353. Alternatively, for a given frequency multiplication factor "A", the EM Instrument can also be size $$\text{“}\frac{c_e}{Ac_a}\text{”}$$

times larger than the equivalent Acoustic Instrument.

Figure 6:
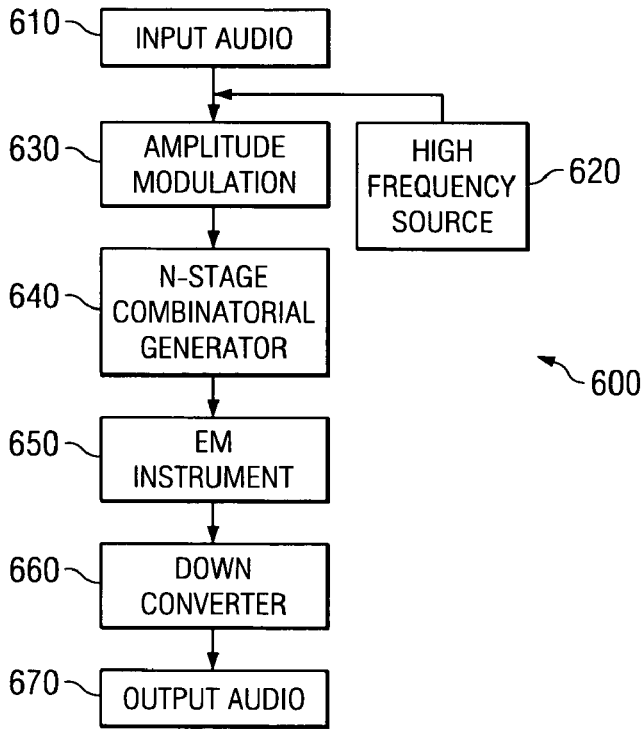
FIG. 6 is a somewhat simplified block diagram illustrating an exemplary electromagnetic instrument system according to one embodiment of the present disclosure.

This frequency conversion can be achieved through a simplified variation on the EM Musical Instrument system 100 of FIG. 1. Referring now to FIG. 6, the reference numeral 600 generally designates an EM Musical Instrument system according to one embodiment of the present disclosure. EM Musical Instrument system 600 takes musical input, input audio 610, and amplitude modulates the input audio through combination with a high-frequency source 620 in Amplitude Modulation (AM) module 630.

The resultant signal is passed to an N-stage combinatorial generator 640, described in more detail below, which applies a frequency multiplication factor to the input signal and passes the resultant signal (the excitation signal) to the EM instrument 650. The response of EM instrument 650 to the excitation signal is recorded and down-converted in frequency by the down converter 660, which produces output audio 670.

Generally, frequency multiplication factors can be realized through either analog or digital methods. One analog method employs input audio to amplitude modulate a carrier frequency higher than the highest input audio frequency, such as, for example, as performed by AM module 630 modulating high-frequency source 620. One skilled in the art will understand that other amplitude modulation mechanisms can also be employed. The amplitude-modulated signal can also be passed through a series of harmonic generator stages, such as, for example, the stages provided by N-stage combinatorial generator 640. At each stage, a particular harmonic is selected, typically through a band pass filter, amplified, and passed on to the next stage. One skilled in the art will understand that various musical effects can also be introduced in one or more stages.

One particularly suitable harmonic generator is a step recovery diode. Generally, step recovery diodes (SRDs) are high frequency harmonic generators, and accept high frequency (10 MHz-20 GHz) input carriers with a bandwidth of up to about five percent. While each SRD is typically capable of a multiplication factor of 20, SRDs can be tuned for input at a specific frequency. Readily available SRDs, for example, accept frequencies of 10 MHz, 100 MHz, 1 GHz, and 10 GHz. In most embodiments, each stage before the last stage nets a multiplication factor of about 10, and the last stage nets a multiplication factor of about 20. In one embodiment, the chain of SRD stages results in a net multiplication factor of about 20,000.

After the chain of SRD stages, or other suitable frequency multiplication, the carrier is stripped from the signal. In one embodiment, the resultant signal is in the range of 200 KHz-200 MHz. It should be understood that the initial clock used to Amplitude Modulate the input audio should be accurate and stable, as any deviations from the desired frequency are also amplified by 20,000. Accordingly, in one embodiment, two concurrent multiplication chains can be employed, one for the clock and one for the input audio. In this embodiment, the dual amplification helps prevent frequency drift of the resultant audio due to shifts in clock frequency.

Figure 7:
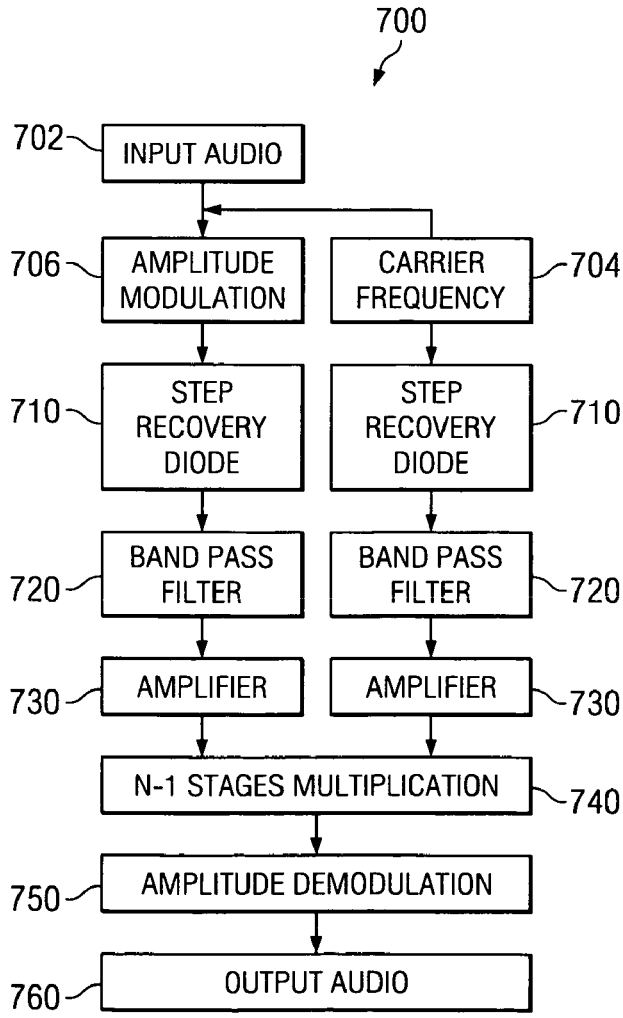
FIG. 7 is a somewhat simplified block diagram illustrating an exemplary electromagnetic instrument system according to one embodiment of the present disclosure.

An exemplary system is shown in FIG. 7. Referring now to FIG. 7, the reference numeral 700 generally designates an EM Musical Instrument system according to one embodiment of the present disclosure. System 700 includes input audio 702 and carrier frequency source 704. Input audio 702 and carrier frequency source 704 provide input to AM module 706, which modulates input audio 702 through carrier frequency source input from carrier frequency source 704 to generate AM modulated output.

Both the AM modulated output and the carrier frequency source output are further manipulated through parallel stages. In particular, carrier frequency source 704 and AM module 706 provide inputs to a corresponding step recovery diode 710. Step recovery diodes 710 provide inputs to a corresponding band pass filter 720. The output of band pass filter 720 is amplified in amplifier 730, and the process repeats through N−1 stages multiplication 740.

The outputs of the two parallel N−1 stages multiplication 740 are combined into a single input to amplitude demodulation module 750. As described above, amplitude demodulation module 750 strips the parallel-amplified carrier frequency from the combined signal to generate output audio 760. Thus, output audio 760 can be generated to minimize frequency drift due to shifts in the carrier frequency source input. Accordingly, the N-stage amplification of the carrier signal along with the input audio can yield additional benefits in the quality of the audio output of system 700.

The analog method described above is particularly suitable for live audio input, as continuous high frequency input results from low frequency input. For example, every one wavelength of input audio at a given frequency results in a multiple of wavelengths in output audio from the first multiplication (SRD) stage alone. Extrapolating through the entire chain, a great number of wavelengths of output are generated from a single wavelength of input audio. Thus, a change in the amplitude of the input signal after one wavelength is not expressed in the EM Instrument until several thousand wavelengths (based on the first input wavelength) have already been expressed in the EM Instrument. So configured, excitation input changes occur slowly within the EM Instrument and as such its resonance reflects steady state behavior, that is, with little or no transients. Much of an Acoustic Instrument's "attack" sound comes from transients, so this process alters the sound of the EM Instrument, illustrating yet another novel musical behavior of EM Instruments.

Since changes in amplitude and frequency input content occur slowly, the output or sound of the EM Instrument also changes slowly. If changes in frequency and amplitude that occur as in the original time scales are desired, the redundant frequency behavior of the output data can be removed. For example, in one embodiment, the input audio signals can be modeled as a discrete set of input vectors in time describing the input signal in frequency space. Each input vector carries the amplitude and phase of the constituent frequencies comprising the input audio signal at that particular instant of time. If the input audio signal does not change significantly over a time period t, the same input audio frequency space vector (at a higher frequency) excites the EM Instrument for time t, resulting in a constant output vector.

Measurements of the EM Instrument output over time t can be used to compute the component frequencies and phase of the EM Instrument output using Fourier Analysis. The accuracy of the resultant analysis is proportional to the number of discrete measurements. For example, 20,000 measurements of the same frequency vector yield a frequency resolution of 2 Hz, assuming a digital audio rate of 44 KHz. This measured vector can then be used to compute the magnitude of the output audio for a particular time. For digital audio output at 44 KHz, a standard audio sample rate, the EM field measured within the instrument should be digitized at 880 MHz (assuming a multiplication factor of 20,000). One skilled in the art will understand that t is determined by the time between samples of output audio, in this case, $$\frac{1}{44{,}000}s,$$

or 44 KHz.

One skilled in the art will understand that a frequency vector is a prescriptive description of a sound. It not only describes an input sound, but also can be employed to create an infinitely long waveform in time with the same frequency content. Further, unless every component frequency may be written as a product of some fundamental frequency and a positive integer, this waveform is non-periodic. Thus, many different waveforms can be generated from the same frequency content by manipulating the time factor by which the waveform is calculated.

Measured Electromagnetic Instrument behaviors can be converted to vectors in frequency space through Fourier Analysis. The phases of these computed vectors are dependent on the time range used to compute the Discrete Fourier Transform. To be the most accurate, the time used to compute the frequency vectors should be the same time used to convert the frequency vectors to a waveform. However, many digital "input" samples (i.e., the response of the EM Instrument) can be used to calculate relatively few "output" samples (i.e., the resultant Audio output). Thus, a representative time should be selected for calculations. For example, where the Electromagnetic samples cover a time range $t_n$ to $t_{n+k}$, a consistent symmetric subset of these time values should be selected in computing the output waveform.

The Fourier Analysis of the measured response gives rise to high frequency vectors (20 MHz-to 20 GHz). These high frequency vectors are subsequently frequency converted to audio frequency vectors. This frequency conversion can be achieved through simple division. For input audio at, for example, 440 Hz that results in output audio with a 440 Hz component, computed frequency values are divided by the multiplication factor. It should be understood that other suitable methods can also be employed.

The series of output frequency vectors in time can be converted to an analog signal by selecting a time for each sample point, summing the magnitude of each component frequency at that point, and then presenting these magnitudes to a Digital-to-Analog Converter (DAC). A non-optimal selected time coordinate for each sample point results in an output waveform with many discontinuities. A significant number of discontinuities will result in pops, and the frequency content of the constructed waveform will not audibly resemble the frequency content of the vectors used to construct it.

One method of choosing a time coordinate is to use the time each vector was measured in the EM instrument. Alternatively, different time values between the processes that measure, compute, and generate the output can be employed. For example, in one embodiment, a time coordinate for computing the frequency vectors is given by $t_n=n\Delta t'+t_0'$, with the magnitudes of these vectors computed using a time coordinate $t_n=n\Delta t+t_0$. Another method, yielding a different output sound, varies the value of $\Delta t'$ and/or $t_0'$ in time. The exact variation of these values determines how they affect output sound. Another method to vary the output waveform uses a different $\Delta t$ between the process that computes the output samples and the DAC that converts these values to a waveform. Further, a given frequency vector can be used to compute only one output sample point or many output sample points.

Discontinuities in the transition between frequency vectors can be smoothed by mixing from a given vector's output to the next vector's output. For example, in one embodiment, each frequency vector is employed to generate sample points from $t_0$ to $t_1$, such that $t_1-t_0=\Delta t$. Where this vector is used to compute sample points for longer than $\Delta t$ (i.e., $t_0-\delta t$ to $t_1+\delta t$), there is a time length of $\delta t$ to transition from one output waveform to the next output waveform. Over this time of $\delta t$, the relative weight of each vector's output can be varied when summing them to transition from output dominated by one vector to output dominated by the next vector. The longer $\delta t$ is, the smoother the transition. Where $\delta t>\Delta t$, more than two vectors determine output in the transition from one vector to the next.

Another method to ensure a good transition from one vector to the next exploits the time dependence of a vector's output. For example, in one embodiment, vector 1 and vector 2 are used to compute a set of output points labeled by $t_1$ and $t_2$ respectively. If the first point in $t_2$ is not sufficiently close in properties (value, derivatives, etc.) to the last value in $t_1$, audio distortion occurs. Since a frequency vector may be used to determine the magnitude of a waveform at any point in time, output points can be calculated using vector 2 until a point that will not cause undue distortion is found.

For example, in one embodiment a time ($t_m$) for vector 2 is selected that generates a point that minimizes the difference (value, derivative, etc.) between itself and the point that vector 1 would have generated (using its own time coordinate). The rest of the points in $t_2$ can be generated using the time $t_m$ for the first sample. The efficiency of this method depends upon how many points must be tested, that is, how far away the first test time is from time $t_m$. Two reasonable choices for the first test time are the time used in the computation of a particular vector, and the time the last vector would be computed with, absent the test time.

Other audio effects can also be manifested by using output frequency vectors in creative ways. For example, in one embodiment, a weighted output can be employed, with the current frequency vector and some number of previously measured (or soon to be measured) frequency vectors used to determine output. The particular weights assigned to current and previous/future vectors determines the output sound. In one embodiment, a vector's weight decreases linearly over time. Alternatively, a vector can be used to determine output at time n, and then n+k, n+2k, etc.

Alternatively, l buffers of length m can be used to create an echo effect. The content of each buffer can be repeated a desired number of times and then refilled using current frequency vectors. The buffers can be staggered in time so that each buffer is at a different stage in its cycle. One skilled in the art will appreciate that the waveform generated from a buffer at two different times need not be the same, as the output of a frequency vector is time dependent. This is in contrast to existent prior art audio effects, which use stored waveforms, wherein waveforms from the same buffer are the same.

Alternatively, each computed frequency vector can be used to determine output for longer than time t. In such an embodiment, input audio lasting A seconds results in output audio lasting A+B seconds. Further, in an alternate embodiment, measured Electromagnetic frequencies can be divided by a number other than the multiplication factor, resulting in a net frequency shift. So configured, input audio at 440 Hz, for example results in output at some other frequency. Judicious selection of the division can cause interesting and novel audio effects.

The above methods are particularly suited for analog input audio. In some EM Instrument system embodiments, however, input audio comes from a digital source. One skilled in the art will understand that a Digital-to-Analog Converter (DAC) can be employed to convert digital information to an analog signal by holding a given digital value for a sample time. In typical DAC systems, upon the next sample, the circuit quickly changes to the new value and holds again. In effect, a DAC generates a staircase approximation of a waveform. This approximation is generally less effective at time scales significantly shorter than the sample time.

For example, typical Step Recovery Diodes (SRDs), or other harmonic generators, used for frequency multiplication respond at short time scales compared to standard audio sample times. From the SRD's perspective, the majority of the observed signal comprises a constant frequency input with a DC offset. The constant frequency input is the carrier frequency and the DC offset makes up the straight portions of the staircase approximation. Thus, this input does not have the same frequency characteristics of the signal it is being used to approximate.

Accordingly, to ensure that the frequency conversion hardware responds to the desired input frequency, a sample rate for the input audio can be selected that is sufficient for measuring Electromagnetic Instruments. For example, a digital input signal can be "up sampled" through interpolation to obtain a higher sample rate signal. Though this computed signal is also an approximation of the input signal, the higher sample rate results in a more closely aligned frequency multiplied signal approximation. It should be understood that there are various methods for interpolating new sample points, each with its own distinguishing characteristics. Alternatively, a DAC that does not provide a staircase approximation of a signal can also be employed. For example, in one embodiment, the DAC can be configured to linearly increase/decrease output voltage in the transition from one sample point to the next according to a particular desired effect. It should be understood that other suitable configurations can also be employed in accordance with the present disclosure.

Additionally, a non-audible test signal can be applied in a "piggyback" fashion with the input audio to measure the exact multiplication factor. As the input signal is of a known frequency and the frequency of this signal after multiplication can be measured, their ratio is the observed multiplication factor. As described above, output audio derived from the analog method is a computed quantity and, therefore, is generated in part with the multiplication factor. By using a dedicated input signal, the multiplication factor can be continuously monitored in time, and subsequently employed to generate appropriate output frequencies. Alternatively, the test signal can be used to ensure a certain multiplication factor is being achieved, that is, to excite a particular range of frequencies. An alternative method inputs a known frequency only for a short period of time. Under this method, once the multiplication factor is determined, it is assumed constant over time.

Significantly, one skilled in the art will appreciate that the particular method of Amplitude Modulation (AM) employed is not important to the method as a whole, but will impact any practical realization. For example, where the lowest frequency harmonic generator operates at 10 MHz, for Single Side Band (SSB) AM, half of the side band frequencies created by Amplitude Modulation should be filtered out. If a 10 MHz carrier is used directly to modulate audio, the spread of frequencies between the desired and undesired signal is too narrow to filter out. In this instance, multiple stages are appropriate. For example, a first stage can include amplitude modulation with a comparatively low frequency, filtering out undesired sidebands. At the next stage, the signal is amplitude modulated again with a higher carrier, again filtering out undesired sidebands. This process can continue until the sum of modulating frequencies adds up to the desired carrier frequency. For signals so modulated, SSB demodulation requires knowledge of the intermediary modulating frequencies for correct operation, as one skilled in the art will understand. Other variations of Amplitude Modulation can include different mixtures of carrier frequency and sidebands.

While Analog conversion methods are often appropriate and can be selected particularly for the resultant effects on the musical output, Digital conversion methods can also be employed. In particular, in one embodiment, Digital frequency conversion can be achieved as follows. Input audio is digitized at some sampling frequency f, recorded, and then converted back to an analog signal using a Digital to Analog converter (DAC) operating at a higher sampling frequency, Af. For audio frequencies, this conversion produces frequencies A times faster. As a standard audio sampling frequency is approximately 44 KHz and state of the art DACs operate at a sampling frequency just over 1 GHz, this process results in a net multiplication factor of about 23,000.

With current technology, this multiplication factor implies that the general input EM Instruments should, in a preferred embodiment, be configured approximately 40 times larger than comparable Acoustic Instruments. Further, in one implementation of this process a completely recorded audio signal can be provided so that the high frequency DAC receives a sufficient stream of input information for continuous operation. In contrast with the Analog process described above, this method preserves the transient response of the EM Instrument. Further, so configured, every one input sample roughly corresponds to one output sample (ignoring reverb effects), so no calculation is required to obtain output audio.

Measured EM output can be converted down in frequency with a reverse process. For example, in one embodiment, measured samples are sent to a DAC operating at slower clock frequency for output. The sample rate used to measure the Electromagnetic Instrument operates 23,000 times faster than current standard CD audio, so 23,000 seconds (approximately five current standard Audio CD) worth of audio can be processed every second within the EM Instrument. One skilled in the art will understand that this ratio will improve as DACs get faster.

A slight variation of this method uses a look-up table to generate music in real time from the musician's perspective. For example, MIDI is a current technological standard that describes arbitrary sounds in a compact notation. It does not contain the sound directly, but rather contains a list of what sounds to generate. A MIDI device can be used to trigger digital samples that are converted to high frequency analog signals, excited in an EM Instrument, measured, converted down in frequency and presented for output, all of which can be done in real-time. Alternatively, MIDI information can be used to construct sounds using pre-recorded Electromagnetic Instrument behaviors.

A more advanced digital implementation can utilize overlapping short snippets of live audio that are fed into the higher speed DAC in short bursts and played in the EM Instrument. The measured responses can then be joined together to create a continuous output. As EM Instrument bodies typically exhibit inherent reverb, sound continues to be heard after the source is removed. One skilled in the art will understand that this effect implies that audio at earlier times effects audio at later times. To get an output sound with this digital method that sounds like all of the input audio was played in a continuous manner (rather than disjointed), the reverb effect can be accounted for in the EM Instrument system. For example, for every new snippet of audio played in the EM Instrument, one or more previous snippets can be re-applied to the EM Instrument or otherwise re-excited.

As a practical matter, a time delay roughly equivalent to the reverb time decay can be included between applied snippets of input audio. As described above, there are typically many more samples per second in an EM Instrument than in the applied audio signals, and thus, the same input audio data can be replayed many times within the EM Instrument and still produce real time output from the musician's perspective. Through this redundant behavior, past instrument states influence future instrument states and it becomes possible to join the separated measured responses of the EM Instrument into one continuous sounding response.

In one embodiment, the lag between the time a live input audio sample is presented to the EM Instrument and the time that its corresponding output is presented is minimized. In this embodiment, "shorter" snippet lengths are preferred. One skilled in the art will understand that "shorter" here is a relative term comparing snippet lengths in this embodiment with snippet lengths in other embodiments. Shorter snippet lengths, however, imply more output joins to create the continuous output, and therefore shorter snippet lengths also imply additional time spent replaying redundant audio data in the EM Instrument. By way of contrast, longer snippet lengths require less work (i.e., joins) to create output, and will result in output with fewer distortions due to the reduced number of joins. The reduced distortion, however, comes at the expense of greater lag between input and output.

In an alternate embodiment, a variable snippet length can be employed. In a variable snippet length system, however, the detection system should be configured to detect a new note while another note is playing. One candidate includes Wavelets, a mathematical transform similar to the Fourier Transform. Wavelets are typically configured to localize signals in both frequency and time. For example, where changes in frequency content manifest as pulses in the high frequency decomposition of the signal, these pulses can be used to trigger a snippet length change.

In an alternate embodiment, in a constant snippet length system, a gate can be employed to determine the beginning of a note. In this embodiment, a gate is activated if the input signal rises above a predetermined threshold value, and deactivates when the signal falls below this threshold. Thus, a constant snippet length method includes compromise between the response time of the system and the amount of joins necessary to create a continuous output signal.

The effect of snippet length and other variables can be better understood through an illustrative example embodiment. This example scenario begins with the first note input to the system. As this is the "first" note input to the system, no music has been played for some previous amount of time, as observed by an absence of EM Instrument output. Significant audio begins and fills up an input audio queue Q of length L. It should be understood that a queue is generally an ordered list such that the first element added is the first element removed. As the last sample of excitation signal Y the input queue from is applied to excite the EM Instrument, the measured response is marked or otherwise noted.

Responses observed after this mark correspond to measurements made while there is no input to the system, and therefore comprise the EM Instrument's reverb response. In one embodiment, the reverb response is dropped and the remaining data is appended to an output buffer. As more audio input samples arrive, they are appended to the input samples already received and the additional input samples are applied to excite the EM Instrument. While this expanded buffer is played, the output is marked at the time when the sample is applied at what was the end of the buffer input, and the output is marked again when the sample is applied at what is currently the end of the buffer.

The first time mark indicates the end of the previous excitation resulting from the initial buffer input, and the second time mark indicates the beginning of the reverb response after the additional audio input. The data between these time marks is new behavior and can to be added to the output buffer. The first time mark also indicates the end of common response between the first measured response and the second measured response. Generally, the common response is two or more measurements of an EM Instrument's response to the same input. This region can be used to join one snippet to another in a coherent way. Normally this can be done to add newly measured snippets to the output buffer.

After the EM Instrument is excited for the second time and the new response is added to the output buffer, playback from the output buffer can begin. For each output sample, there is an input sample. So after l samples of audio have been output, a new input buffer can be applied to excite the EM Instrument. For the purposes of this example, the measurement of the EM Instrument can be considered substantially instantaneous. That is, the measured EM response is suitable to append to the output immediately, with l samples in the output buffer with which to enact this join. Further, the longer the delay before beginning playback, the more samples available to join new measured behavior. For example, in one embodiment an input buffer length of 2l can be employed for the first note (i.e., gate activation). Output generally will not start for this time anyway, which also eliminates one join.

This method continues to append incoming audio samples to all of the previous input samples, exciting the EM Instrument from the first input sample after each appended input audio sample. The end of the whole previous signal is marked in output as it excites the EM Instrument, and the end of the current signal is also marked in output as it excites the EM Instrument. In the same process as before, the first mark indicates the end of common response, the second mark indicates the beginning of reverb response, and the data in between is added to the output buffer.

As described above, joinder of two audio samples can be achieved in a variety of ways. For example, the time marks on two consecutive measured responses can indicate one way to arrange the two responses in time relative to each other. The first time mark in measured response n corresponds to the second time mark in measured response n−1. These points can be understood to occur at the same point in the EM Instrument's response time. Thus, the common response points (points in both n and n−1 measured before the first time mark in n) can be used to find the "best" point to transition from one snippet to the other. The "best" point to transition from one snippet to another can be identified and selected through several methods.

One method calculates the difference between the value, first derivative, second derivative, etc. of two common points. The pair of points (one in n, the other in n−1) that minimizes those differences is one "best" point to join the two outputs together. Before the join, overall output consists of response n−1. After the join, overall output consists of response n. If there are several points with similar differences, the "best" among them can be selected by extending this analysis to surrounding points.

The aforementioned joinder method can continue until the input audio exceeds the reverb time. The reverb time can be measured through a variety of methods. In one embodiment, "reverb time" is the time during which the EM. Instrument exhibits a response above a predetermined threshold after the input excitation signal ceases. So configured, the reverb time is also the minimum amount of past response to be measured before any new behavior is measured. Any additional past behavior (e.g., as introduced by a buffer with audio input longer than the reverb time) that is observed in preparation for a new measurement allows measurement of the EM Instrument's response to an inputs previously applied, and for which the EM Instrument's response is already in the output buffer—that is, the common response. This common response allows for a smooth transition from one snippet to the next, as described above, so the longer the common response time, the higher the likelihood of a smooth-fitting join and continuous output audio.

A particular example of the effect and employment of common response is illustrative. For example, when newly received input is ready to excite the EM Instrument, the EM Instrument is made ready to receive this new input by exciting past behavior. That is, as described above, in one embodiment, the entire prior excitation signal is applied to the EM Instrument before applying the appended input signal. In one particular embodiment, an amount of prior excitation input lasting longer than reverb time is used to excite the EM Instrument in preparation for the new input. As before, reverb time after the first sample of the current excitation is played is marked in the measured response. When the last sample from the previous input is played during the current input, the measured response is marked again. Finally, as the last sample of the current excitation snippet is played, the measured response is marked a third time. As described above, "marking" the measured response can include inserting a tag or other suitable code into the measured response. Samples before the reverb time mark in the measured signal are ignored, samples in between this mark and the second mark are common response, samples between the second mark and the third mark represent new EM Instrument behavior in response to the appended audio input, and samples after the third mark represent the reverb response of this new behavior. One skilled in the art will understand that if only reverb time of past audio is used to prepare new input, then the first and second time marks coincide.

While the coincidental mark joinder method described above offers one embodiment of joinder in accordance with the present disclosure, in some instances, some joinder points will be more difficult than others to combine to yield a smooth-sounding transition. For example, it is known that Electromagnetic cavities are capable of producing chaotic behavior. One skilled in the art will understand that chaos is marked, in part, by exponentially divergent solutions to slight differences in input data. Accordingly, a chaotic EM Instrument can be excited with the exact same input multiple times without ever generating the same output signal in response. In fact, the output samples from chaotic EM Instruments will typically all be very different from each other. In such a system, it is highly unlikely to ever find a "good" point to join two signals by the above coincidental mark method.

Thus, an alternative joinder method can be employed that sums the two signals together over their common region with relative weights that change in time. For example, in one embodiment, at the beginning of the join length, overall output is comprised purely of the previously observed EM Instrument behavior. At the end of the join, the overall output consists purely of newly measured behavior. How the weights vary in between can be purely arbitrary, though each particular function will exhibit its own unique sound characteristics. Examples include mixing the signal linearly, logarithmically, exponentially, or sinusoidally. Some functions, such as a sinusoidal dependence, will have a significant effect on the sound of the join, which also illustrates a new area where sound modification may be made. One skilled in the art will understand that any suitable mix function can be employed, depending in part on the effect desired in the output audio.

Further, as described above, some sections of measured EM. Instrument behavior can be ignored to focus on creating continuous output audio. In an alternate embodiment, however, the ignored responses need not be discarded. For example, the output signals can be constructed as described above, with the reverb sound appended at the end of each response and the past instrument behavior reconstruction at the beginning of each response. These effects can thus be employed to produce an output that sounds like each part of the input signal is the first and last thing played in the EM Instrument. One skilled in the art will understand that this feature is not possible with modern Acoustic Instruments.

These non-Acoustic solutions can also be selectively routed through audio effects, further opening sonic possibility. Further, one skilled in the art will understand that efforts to create continuous-sounding audio output can also be discarded. That is, a "continuous" sound response is a construct of Acoustic behavior. The actual, non-continuous response of an EM Instrument need not be manipulated to form familiar-type "music." Thus, in one embodiment, two separately measured signals can be joined at a point where they do not represent common EM Instrument response. The modifications that can be performed in a joinder are, in one sense, limited only by the imagination of the user. The input signals can be modified with effects that vary between excitations, the EM Instrument response can be measured with no manipulation whatsoever, or any number of methods can be combined, each adding to the overall output with user-determinable weights.

Further, marking the measure response can also yield additional benefits. For example, in one embodiment as described above, as the end of an input signal excites an EM Instrument, the measured response is marked. This method ensures that reverb response is not being measured, but rather behavior while the EM Instrument is still being excited. A more complex method can account for the transit time of the information from the excitation location to the measurement location. For example, in free space, Electromagnetic fields travel at $$3\times10^8\frac{m}{s}.$$

In a waveguide, however, the phase and group velocity of a wave is dependent upon the waveguide and the frequency content of the wave. Approaching the cut off frequency for a waveguide, the phase velocity increases and the group velocity decreases.

There can therefore be a significant delay between the time of excitation and the first response from the measurement location. This is a frequency dependent quantity, so in any complex signal, the minimum first response time should be used, to ensure that the measured response is not merely reverb. A delay equivalent to the first response time after the last sample of the current excitation signal can be inserted prior to marking the output, which improves the quality of the audio information output per instrument excitation.

Moreover, the above excitation and conversion describes primarily analog-type responses of EM Instruments. Digital modes of EM Instruments are also possible. For example, in one embodiment, a digital model can be generated by measuring the impulse response of the EM Instrument. The measured behavior in response to an impulse can then be manipulated on a computational device to produce an effect as if a particular desired input sound was used to excite the EM Instrument.

This manipulation can be accomplished by taking the convolution of the impulse response with the input sound. In an alternate embodiment, the Laplace Transform of the impulse response can be calculated and multiplied with the Fourier Transform of the input signal. Additionally, there are existent products that employ measurements of real world instruments to recreate those instruments digitally (e.g., Line_6's POD). The same type of measurements can be made of Electromagnetic Instruments and used on existent hardware to reproduce the sounds of Electromagnetic Instruments in response to particular inputs. For example, recordings of percussive EM Instruments, such as EM drums and cymbals, can be made and used in conjunction with known digital drum sets.

Additionally, certain traditional electric instruments can be employed to excite an EM Instrument. For example, in one embodiment, a traditional electric instrument can be substituted for EM Signal Generator 104 of FIG. 1. The electrical separation between input source and EM Instrument body allows for audio effects such as distortion, wah, reverb, delay, echo, chorus, and flange to be applied before the electrical waveform is used to excite the EM instrument body.

This configuration is theoretically equivalent to playing an Electric Instrument through an Acoustic Instrument. It combines the versatility of Electric Instruments with the beautiful resonant sounds of Acoustic Instruments. Further, the electrical disconnect between the excitation Electric Instrument and the EM Instrument implies that the electric input can be coupled to any location on the EM Instrument. Different excitation locations have a different admittance (frequencies at which energy may be transferred to the body) and different measurement locations have different transfer functions, both of which result in a psuedounique tone.

Generally, "psuedounique" means that many, but not necessarily all, combinations of measurement and excitation location will result in a unique tone. These tonal shifts only occur for the EM instrument though, the Electric instrument still responds in the usual manner. In an Acoustic guitar, for example, the admittance of the bridge greatly influences the behavior of strings. Input energy transferred from the string to the body causes the top plate to resonate. If this resonance does not have a node at the bridge, it will cause the bridge to move in and out of the plane of the instrument. This movement couples back to the string. Different bridge admittance functions result in different bridge movement and therefore different string behavior. This same kind of interaction can be created between Electric Instruments and Electromagnetic Instruments.

For example, the bridge of an electric guitar can be comprised of one or more motors that control the position of each string support. These motors are controlled by input waveforms, so an input frequency of 440 Hz would cause the string supports to oscillate at 440 Hz. Essentially, the string can be driven by input music. If measured behavior of EM radiation inside an EM instrument is fed into this bridge system, then the string responds as if it was connected to an Acoustic Instrument at that location. Additionally, a different measurement location can be employed for each string. Given that EM Instruments can be excited with arbitrary waveforms, this interaction can exhibit string behavior not encountered with Acoustic Instruments. While presented using guitars as an example, the behavior can be more generally applied. Feedback from any measured EM Instrument can be used to influence the behavior of the input source.

As described above, the excitation signal and the response of the EM Instrument to the excitation signal can be further manipulated to yield desired audio effects. These audio effects can be introduced at various points in the process, such as, for example, by Audio Input Module 102, EM Signal Generator 104, EM Output Receiver 120, EM Output Effects Module 122, and Audio Output Module 126 of FIG. 1. The particular configuration and functionality of these modules can be tailored to the desired audio effect.

For example, as described above, many tonal effects normally observed in everyday life are due to relative differences in the audible receipt of the same signal. For example, short or long delays (in terms of reverb) between copies of the same sound played simultaneously can sound like the listening point is in an enclosed room or in a cathedral. The sound of the room due to size arises in part due to the finite propagation speed of Acoustic fields. Electromagnetic fields also propagate finitely fast; therefore, sound effects due to the space the sound is in also occur Electromagnetically. Therefore, EM Instruments can be configured for a more consistent sound through location in "good" Electromagnetic spaces. For example, a "good" Electromagnetic space isolates the EM instrument and both keeps the music (i.e., the EM response output) inside and the outside world out. In a preferred embodiment, this space should be Electromagnetically interesting just as studios, concert halls, and other Acoustic-oriented spaces are Acoustically interesting.

Spaces are typically made Acoustically interesting through the use of design, scatterers and absorbers, and other known techniques. The same kind of considerations and techniques used for Acoustic spaces can also be applied to Electromagnetic spaces. In one embodiment, EM Scatterers can be made by forming shapes with sheets of metal that promote destructive interference. This interference can be achieved by configuring the EM scatterers with many angular sections whose normals point in many directions on one sheet. Or, in an alternate embodiment, a series of shapes that protrude with different lengths from a common plane can also be employed. Alternately, an EM scatterer can be configured with a pattern of a series of angular sections, with that pattern repeated several times with different orientations. In an alternate embodiment, absorbers can be coupled to the reflectors. One skilled in the art will understand that different materials have different frequency characteristics, and therefore can produce a different sound effect.

Audio effects that rely on timing differences can also be realized at Electromagnetic frequencies. For example, "flange" can be created by mixing two copies (identical or not) of a sound together with a short time delay. In this instance, a short time delay is typically less than about 15 ms. Further, if this time delay varies in time, a certain effect is achieved. With a constant time delay, another effect is achieved. How strongly the two signals are mixed together produces another effect. If this delay is increased (to, for example, 15-30 ms) then a fuller, denser sound results. Delays above this time frame are resolvable by the human ear, and are typically heard as echoes. Independently changing the pitch of the sounds to be mixed results in a chorus-effect. Thus, all of these effects, currently in use at audio frequencies, can be implemented at Electromagnetic frequencies. Further, one skilled in the art will understand that that these musical effects can be inserted at any point in the signal chain between input and output of the Electromagnetic Instrument, or, as described above, be inserted after the measured EM Instrument response.

Figure 8A:
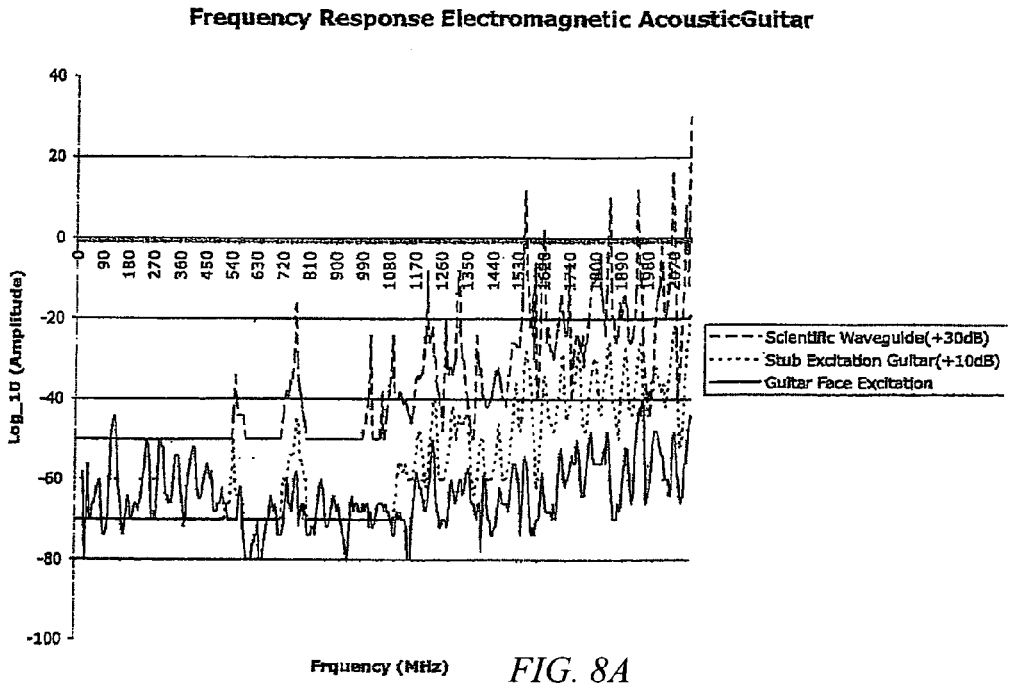
FIGS. 8A-8B are somewhat simplified graphs illustrating specific frequency responses of an exemplary electromagnetic instrument according to one embodiment of the present disclosure.
Figure 8B:
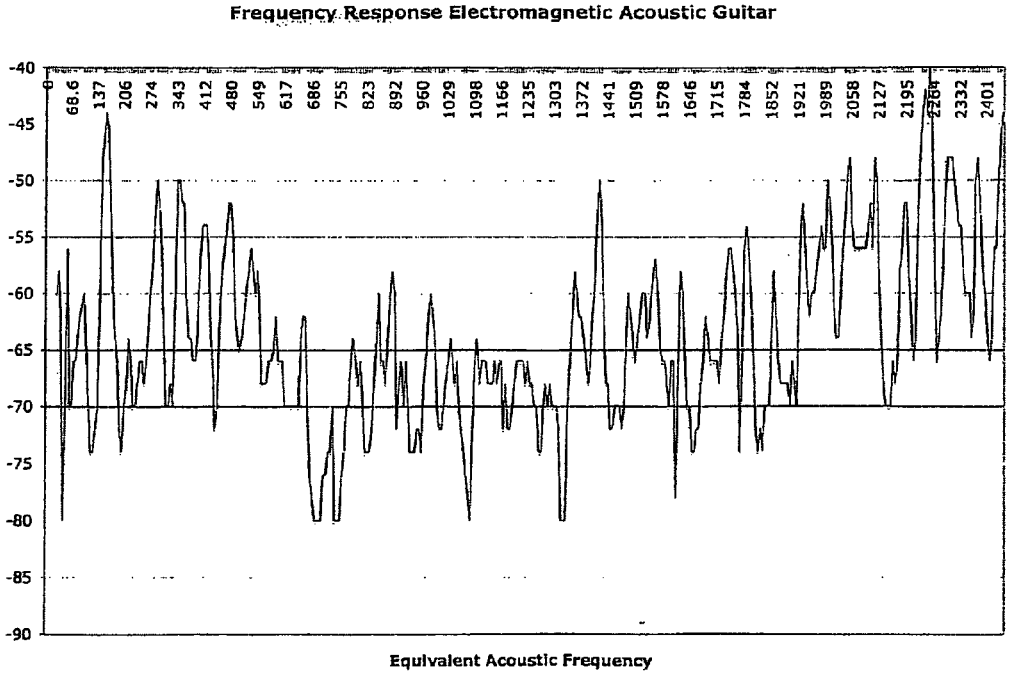

Having described various embodiments above, certain experimental results are informative. FIGS. 8A and 8B illustrate the frequency responses of a guitar-based EM Instrument. In this embodiment, the EM instrument was modeled on an Acoustic guitar, and comprised a guitar-shaped "top" or "face" plate, a guitar-shaped "bottom" plate, and a conductive sidewall coupling the top and bottom plates. Each plate was constructed from plywood with aluminum foil glued to cover the plate. The sound hole was implemented by cutting away a section of the aluminum foil on the top plate. The plates were mounted to an exterior box frame, which provides EM-inactive support for the EM Instrument body. Each plate was also ringed with copper tape with a conductive adhesive, which extended the conductor through the edge of the plate, thereby augmenting electrical contact between the plates and the conductive sidewall. The conductive sidewall was constructed from common wallpaper covered on one side with aluminum foil, and coupled to the top and bottom plates with clear non-conductive packing tape. The electrical connection between the sidewall and a plate is configured so that it can be disrupted by slipping a piece of paper between the sidewall and the edge of copper tape on each plate.

Referring now to FIG. 8A, shown are three frequency response curves, representing the EM response of three configurations of the above guitar-based EM Instrument embodiment. The "Scientific Waveguide" curve illustrates the configuration wherein both plates and the conductive sidewall are electrically connected, with no sound hole, and the instrument body grounded. The EM Instrument was excited with a stub tuner applied to the back plate at the normal bridge position of a standard Acoustic guitar. The EM response was measured on the front plate, at the normal sound hole position of a standard Acoustic guitar. Excitation and measurement were accomplished through N-type chassis connectors.

The "Stub Excitation Guitar" curve illustrates the configuration wherein the top plate is electrically disconnected from the sidewall and bottom plate, with a sound hole introduced in the top plate, and the instrument body grounded. The EM Instrument was excited with a stub tuner applied to the back plate at the normal bridge position of a standard Acoustic guitar. The EM response was measured on the front plate, near the sound hole. Excitation and measurement were accomplished through N-type chassis connectors.

The "Guitar Face Excitation" curve illustrates the same physical configuration as the "Stub Excitation Guitar" except for the excitation mechanism. In this configuration a coaxial cable was coupled to the EM Instrument body by removing the cable connector's outer shield and wedging the revealed center conductor against the outside surface of an N-Type chassis connector body. In this configuration the EM Instrument body was thus explicitly driven like a capacitor. This capacitance reacted with the inductance of the sound hole to create the low frequency behavior.

One skilled in the art will recognize that this behavior is very similar to the resonance of an Acoustic guitar. However, where an Acoustic guitar's resonance continues to decrease after 1000 Hz, the EM Instrument's response increases and transitions smoothly to waveguide resonance. As illustrated, the Power spectrum of the EM Instrument over the frequency range is comparatively even. In fact, this characteristic is shown even without a sound hole, as illustrated in FIG. 8B.

One skilled in the art will appreciate that the frequency responses so described are particular to the specific embodiment through which they were observed. The responses confirm that an Electromagnetic Musical Instrument can exhibit both similar behaviors to an Acoustic Instrument and novel musical behavior. Further, even the behaviors similar to Acoustic Instruments include novel musical behavior.

Accordingly, given the various embodiments described above, with the benefits of the teachings herein, a number of various EM Musical Instruments and systems can be configured to provide novel musical sounds. Further, the various configurations for supporting EM Musical Instrument systems can enhance the sound palette available to musicians operating EM Musical Instruments.

Accordingly, one embodiment of the present disclosure provides computational models that demonstrate that Electromagnetic fields are capable of affecting the tone of music in musical ways. For example, if a given number of point charges that can be manipulated at will in space are accelerated, the point charges radiate. If the acceleration of these charges is musical, then the radiation should be musical.

According to one embodiment of the present disclosure, a computer could be used to model this system, with recorded digital music employed as input to determine the position, velocity, and other characteristics of the charges. Some types of recorded digital music are particularly useful in this model. For example, traditional pickups on existent electric string instruments respond to the velocity of the instrument's strings. Thus electric string instrument recordings can be used to represent the velocity of a charge in time, with an integration routine to determine the charge's position in time. With this information, the Retarded Scalar and Vector Electromagnetic Potentials can be calculated at any number of points in space. Further, the Electric and Magnetic fields can be calculated using known spatial and temporal derivatives.

According to one embodiment of the present disclosure, models have been employed in a laboratory environment to listen to the musical effect of Electromagnetic fields. Relatively far away from the charges, there is no noticeable modification. The effect appears similar to the minimal difference between, for example, songs heard on a radio receiver and songs heard on a Compact Disc player.

According to one embodiment, the present disclosure as the listening point approaches the charges, the Electromagnetic field begins to affect the sound, adding its own tone to the sound according to one embodiment of the present disclosure. When the listening point is close enough to the charge field to observe the spatial movement of the charge, the Electromagnetic field generally creates harmonics of the driving frequencies of the underlying musical acceleration. The relative amplitudes of the generated harmonics from the Electromagnetic field's effect are dependent upon the system and measurement location.

According to one embodiment, the present disclosure, with a relatively large number of additional harmonics, provides the musical effect of "distortion. With a relatively small number of additional harmonics, in one embodiment, the present disclosure achieves an increase in the musical effect of "brightness." Furthermore, many common audible tonal effects are due to relative temporal differences in when multiple copies of the same signal arrive at the listening point. For example, short or long delays between two copies of the same sound played simultaneously, as caused by, for example, the tonal effect of "reverb," can sound as if the listening point is in a room or in a cathedral.

These sonic tones and effects arise due to the finite propagation speed of Acoustic fields. Electromagnetic fields also propagate finitely fast; therefore, the same types of temporal effects occur in both Acoustic and Electromagnetic fields. However, if the listening point is directed towards only one charge in free space, there are no audible temporal effects and the only mechanism by which the sound may be altered is through the Electromagnetic fields. Thus, even in the simple system represented by a single point charge, the Electromagnetic field is able to alter input sounds musically. The ability to employ and control Electromagnetic fields to manipulate music takes a fundamentally different approach to creating new musical behavior, which can lead to tremendous artistic advances.

All references cited herein are incorporated by reference to the maximum extent allowable by law. To the extent a reference may not be fully incorporated herein, it is incorporated by reference for background purposes and indicative of the knowledge of one of ordinary skill in the art.

In the detailed description of the preferred embodiments above, reference is made to the accompanying drawings, which form a part hereof, and in which is shown by way of illustration specific preferred embodiments in which the disclosure may be practiced. These embodiments are described in sufficient detail to enable those skilled in the art to practice the disclosure, and it is understood that other embodiments may be utilized and that logical mechanical and electrical changes may be made without departing from the spirit or scope of the disclosure. To avoid detail not necessary to enable those skilled in the art to practice the disclosure, the description may omit certain information known to those skilled in the art. The detailed description is, therefore, not to be taken in a limiting sense, and the scope of the present disclosure is defined only by the appended claims.

It may be advantageous to set forth definitions of certain words and phrases used in this patent document. The term "couple" and its derivatives refer to any direct or indirect communication between two or more elements, whether or not those elements are in physical contact with one another. The terms "include" and "comprise," as well as derivatives thereof, mean inclusion without limitation. The term "or" is inclusive, meaning and/or. The phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like.

While this disclosure has described certain embodiments and generally associated methods, alterations and permutations of these embodiments and methods will be apparent to those skilled in the art. Accordingly, the above description of example embodiments does not define or constrain this disclosure. Other changes, substitutions, and alterations are also possible without departing from the spirit and scope of this disclosure, as defined by the following claims.

I claim:

1. An electromagnetic (EM) musical instrument system, the system comprising:

an excitation signal generator to generate an excitation signal;

an excitation signal applier to receive the excitation signal and to transmit an unmodulated corresponding excitation signal to an EM musical instrument, wherein the excitation applier is coupled to the excitation signal generator; and an EM musical instrument to modify the corresponding excitation signal and generate an EM output signal associated with a produced sound.

2. The system of claim 1, wherein the EM musical instrument comprises an EM output receiver to receive the EM output signal.

3. The system of claim 2, wherein the excitation signal applier comprises a polarization filter to polarize the corresponding excitation signal.

4. The system of claim 2, wherein the EM output receiver comprises a polarization filter to polarize the received EM output signal.

5. The system of claim 2, wherein the EM output receiver comprises:

an antenna to receive the EM output signal; and a recorder coupled to the antenna to record a storable facsimile of the received EM output signal.

6. The system of claim 2, wherein the EM output receiver is coupled to the excitation signal generator.

7. The system of claim 6, wherein the EM output receiver generates a feedback signal in response to the received EM output signal and transmits the generated feedback signal to the excitation signal generator.

8. The system of claim 7, wherein the excitation signal generator is further configured to generate the unmodulated excitation signal in response to a received feedback signal.

9. The system of claim 2, wherein the EM output receiver is further configured to modify the received EM output signal for audio effects.

10. The system of claim 9, wherein the excitation signal applier comprises a plurality of step recovery diodes.

11. The system of claim 10, wherein the excitation signal applier further comprises a bandpass filter.

12. The system of claim 11, wherein the excitation signal applier further comprises an Alfvén loop.

13. The system of claim 2 further comprising an EM output effects module coupled to the EM output receiver and configured to modify the received EM output signal for audio effects.

14. The system of claim 13, wherein the EM output effects module further comprises an analog to digital converter.

15. The system of claim 2 further comprising an EM output converter coupled to the EM output receiver and configured to convert the received EM output signal to an audio output signal at an audible frequency.

16. The system of claim 2 further comprising:

an audio output module coupled to the EM output receiver and configured to generate an audio output signal in response to the EM output signal.

17. The system of claim 16, wherein the audio output module comprises an analog to digital converter.

18. The system of claim 17, wherein the audio output module is configured to generate an audio output signal at an audible frequency.

19. The system of claim 2 further comprising:

an interface coupled to the EM output receiver and to the Internet and configured to generate a remote output signal in response to the EM output signal; and a user interface coupled to the Internet and configured to receive the remote output signal and to generate an audio output signal in response to the received remote output signal.

20. The system of claim 19, wherein the remote output signal is a digital audio signal.

21. The system of claim 1, wherein the excitation signal applier is further configured to modify the corresponding excitation signal for audio effects.

22. The system of claim 21, wherein the audio effects comprises at least one of:

a reverb audio effect, a wah audio effect, a flange audio effect, a delay audio effect, an echo audio effect, a chorus audio effect, and a distortion audio effect.

23. The system of claim 1 further comprising:

a user interface coupled to the excitation signal generator and configured to receive input from a user, wherein the excitation signal generator further configured to generate the excitation signal in response to received user input.

24. The system of claim 1 further comprising:

an audio input module coupled to the excitation signal generator and configured to generate an audio input signal, wherein the excitation signal generator further configured to generate the excitation signal in response to a received audio input signal.

25. The system of claim 24, wherein the EM output receiver is coupled to the audio input module and is further configured:

to generate a feedback signal in response to the received EM output signal, to transmit the generated feedback signal to the audio input module, and to generate the audio input signal in response to the received feedback signal.

26. The system of claim 24 further comprising:

a user interface coupled to the audio input module and configured to receive input from a user, wherein the audio input module further configured to generate the audio input signal in response to received user input.

27. The system of claim 24, wherein the audio input module generates the audio input signal in response to received analog musical input.

28. The system of claim 27, wherein the audio input module further comprises an analog to digital converter.

29. The system of claim 24, wherein the audio input module is configured to generate the audio input signal in response to received musical information input.

30. The system of claim 29, wherein the musical information input is Musical Instrument Digital Interface (MIDI) input.

31. The system of claim 29, wherein the musical information input is a digital input signal.

32. The system of claim 29, wherein the musical information input includes information associated with the EM instrument.

33. The system of claim 24, wherein the excitation signal generator is further configured to convert the received audio input signal to an electromagnetic excitation signal.

34. The system of claim 1 further comprising:

an interface coupled to the excitation signal generator and to the Internet and configured to receive remote user input and to operate the excitation signal generator in response to received remote user input; and a user interface coupled to the Internet and configured to receive local user input, to generate remote user input in response to received local user input, and to transmit remote user input to the interface.

35. A method for generating electromagnetic music, the method comprising:

generating an unmodulated excitation signal;

applying the unmodulated excitation signal to an electromagnetic (EM) musical instrument having:

a body and EM characteristics that differ from one or more EM characteristics of a free space adjacent to the EM musical instrument; and a port coupled to the body and configured to receive the excitation signal and to apply the received excitation signal to the body;

measuring the response of the EM musical instrument to the excitation signal; and recording the measured response to generate an electromagnetic musical signal.

36. The method of claim 35 further comprising manipulating the electromagnetic musical signal for audio effects.

37. The method of claim 35 further comprising converting the electromagnetic musical signal to an audible signal.

38. The method of claim 35 further comprising receiving user input and generating the excitation signal response to received user input.

39. The method of claim 35, further comprising:

receiving user input from a user through a connection to the Internet;

generating the excitation signal in response to received user input;

converting the electromagnetic musical signal for transmission over the Internet; and transmitting the converted electromagnetic musical signal to the user through a connection to the Internet.

40. The method of claim 35 further comprising:

polarizing the excitation signal to generate a polarized signal; and applying the polarized signal to the EM musical instrument.

41. An electromagnetic (EM) musical instrument system, the system comprising:

an excitation signal generator to generate an excitation signal; and an excitation signal applier to receive the excitation signal and to transmit a corresponding unmodulated excitation signal to an EM musical instrument, wherein the excitation applier is coupled to the excitation signal generator;

an EM musical instrument to modify the corresponding excitation signal and generate an EM output signal associated with a produced sound; and an EM output receiver coupled to the EM musical instrument to receive the EM output signal, wherein excitation signal applier is further configured to modulate the corresponding excitation signal to produce audio effects.

* * * * *